US008800466B1

(12) United States Patent
Shimozono et al.

(10) Patent No.: US 8,800,466 B1
(45) Date of Patent: Aug. 12, 2014

(54) INFLATABLE WATERCRAFT WITH REINFORCED PANELS

(75) Inventors: Gary Shimozono, Kapolei, HI (US); Scott Yamashita, Honolulu, HI (US); Steven C. H. Loui, Honolulu, HI (US); Eric Schiff, Honolulu, HI (US); Jeff Kline, Saverna Park, MD (US); Christopher J. Hart, Laurel, MD (US)

(73) Assignee: Navatek, Ltd., Honolulu, HI (US)

( * ) Notice: Subject to any disclaimer, the term of this patent is extended or adjusted under 35 U.S.C. 154(b) by 289 days.

(21) Appl. No.: 13/166,795

(22) Filed: Jun. 22, 2011

Related U.S. Application Data

(60) Provisional application No. 61/442,171, filed on Feb. 11, 2011, provisional application No. 61/357,946, filed on Jun. 23, 2010.

(51) Int. Cl.
*B63B 7/00* (2006.01)

(52) U.S. Cl.
USPC ..... 114/345

(58) Field of Classification Search
USPC ..... 114/283, 292, 343, 345, 352, 353, 354, 114/355, 357, 364, 61.1, 61.2, 61.25, 61.32, 114/61.33, 68, 69, 77 R, 77 A, 78, 84, 88
See application file for complete search history.

(56) References Cited

U.S. PATENT DOCUMENTS

| | | | | |
|---|---|---|---|---|
| 1,195,857 | A | 8/1916 | Royston | |
| 2,334,072 | A | 11/1943 | Cooper | |
| 2,408,789 | A | 10/1946 | Luisada | |
| D154,774 | S | 8/1949 | Harris, et. al. | |
| 2,873,459 | A | 2/1959 | Marz | |
| 2,999,253 | A * | 9/1961 | Lewis | 114/347 |
| 3,011,184 | A | 12/1961 | Curcio | |
| 3,190,587 | A | 6/1965 | Fries | |
| 3,316,874 | A | 5/1967 | Canazzi | |
| 3,513,494 | A * | 5/1970 | Tailer | 114/345 |
| 3,559,920 | A * | 2/1971 | Moore | 244/5 |
| 4,031,580 | A * | 6/1977 | Neumann et al. | 114/347 |
| 4,090,270 | A * | 5/1978 | Horan | 114/345 |

(Continued)

FOREIGN PATENT DOCUMENTS

| | | | |
|---|---|---|---|
| CN | 200981632 | Y | 11/2007 |
| CN | 101712370 | A | 5/2010 |

(Continued)

OTHER PUBLICATIONS

Chris Hart, Application of Inflatable (Drop-Stich Fabric) Technology to an Entrapment Tunnel Hull-form to yield a High-Performance Inflatable Boat for SOCOM Unique Missions, Abstract, Department of Ocean and Resources Engineering Seminar, Oct. 21, 2009.

(Continued)

*Primary Examiner* — Daniel V Venne
(74) *Attorney, Agent, or Firm* — Goodsill Anderson Quinn & Stifel, LLP

(57) ABSTRACT

An inflatable watercraft is provided with multiple reinforced panels that are configured to form a center hull having a V-form. The center hull supports a floor that is coupled to a U-form collar. The panels also form a pair of outer side hulls respectively disposed on opposite sides of the center hull and which define a tunnel between the center hull and each of the outer side hulls.

5 Claims, 16 Drawing Sheets

(56) References Cited

U.S. PATENT DOCUMENTS

| | | | | |
|---|---|---|---|---|
| 4,091,761 | A | 5/1978 | Fehn | |
| 4,231,314 | A | 11/1980 | Peters | |
| 4,251,893 | A | 2/1981 | McCrory et al. | |
| 4,462,331 | A | 7/1984 | McCrory | |
| 4,603,651 | A | 8/1986 | Harding | |
| 4,640,217 | A | 2/1987 | Ferronniere | |
| 4,722,292 | A | 2/1988 | Marino et al. | |
| 4,723,502 | A | 2/1988 | Sayama | |
| 4,858,550 | A | 8/1989 | Bellia | |
| 4,907,997 | A | 3/1990 | Hall | |
| 5,088,434 | A | 2/1992 | Harding | |
| 5,152,243 | A | 10/1992 | Kuan | |
| 5,158,821 | A | 10/1992 | Gebauer et al. | |
| 5,415,120 | A | 5/1995 | Burg | |
| 5,452,676 | A | 9/1995 | Fiore | |
| 5,565,264 | A | 10/1996 | Howland | |
| 5,570,650 | A | 11/1996 | Harley | |
| 5,642,685 | A | 7/1997 | Garnier | |
| 5,837,623 | A | 11/1998 | Howland | |
| 5,868,095 | A | 2/1999 | Zeromski et al. | |
| 5,943,978 | A | 8/1999 | Garnier | |
| 5,964,176 | A | 10/1999 | Grunau et al. | |
| 6,164,237 | A | 12/2000 | Coryell et al. | |
| 6,192,822 | B1 | 2/2001 | Lavorata et al. | |
| 6,209,476 | B1 | 4/2001 | Maurel et al. | |
| 6,216,622 | B1 | 4/2001 | Lindstrom et al. | |
| 6,293,216 | B1 | 9/2001 | Barsumian | |
| 6,619,224 | B1 | 9/2003 | Syfritt | |
| 6,860,220 | B2 | 3/2005 | Fleming | |
| 6,863,014 | B2 * | 3/2005 | Hudson et al. | 114/347 |
| 6,868,798 | B2 | 3/2005 | Robinson et al. | |
| 6,925,953 | B1 | 8/2005 | Batista et al. | |
| 6,983,713 | B1 | 1/2006 | Robinson et al. | |
| 7,032,258 | B2 | 4/2006 | O'Hanlon | |
| 7,093,553 | B2 | 8/2006 | Robinson et al. | |
| 7,159,529 | B2 | 1/2007 | Durand et al. | |
| 7,185,600 | B2 | 3/2007 | Toussi et al. | |
| 7,418,915 | B2 | 9/2008 | Campbell | |
| 7,530,321 | B2 | 5/2009 | Dingel et al. | |
| 7,552,694 | B2 | 6/2009 | Dingel et al. | |
| 7,748,339 | B2 | 7/2010 | Oh | |
| 7,840,387 | B1 | 11/2010 | Spexarth | |
| 7,861,662 | B2 * | 1/2011 | Rista | 114/345 |
| 7,992,511 | B2 * | 8/2011 | Chon | 114/345 |
| 2002/0100406 | A1 | 8/2002 | Costa, Jr. et al. | |
| 2005/0016435 | A1 | 1/2005 | Robinson et al. | |
| 2005/0279269 | A1 | 12/2005 | Robinson et al. | |
| 2006/0075954 | A1 | 4/2006 | Robinson et al. | |
| 2006/0137592 | A1 | 6/2006 | Loui et al. | |
| 2007/0131155 | A1 | 6/2007 | Dingel | |
| 2007/0215029 | A1 | 9/2007 | Campbell | |
| 2008/0210150 | A1 | 9/2008 | Loui et al. | |
| 2008/0250999 | A1 | 10/2008 | Sorrentino | |
| 2008/0276855 | A1 | 11/2008 | Dingel | |
| 2009/0241825 | A1 | 10/2009 | Barsumian | |
| 2010/0311292 | A1 | 12/2010 | Ibsen | |
| 2011/0036284 | A1 | 2/2011 | Chon | |
| 2011/0056425 | A1 | 3/2011 | Campbell et al. | |

FOREIGN PATENT DOCUMENTS

| | | | |
|---|---|---|---|
| EP | 0013114 | A1 | 7/1980 |
| EP | 0154964 | A2 | 9/1985 |
| EP | 0693420 | A1 | 1/1996 |
| FR | 2621551 | A1 | 4/1989 |
| FR | 2754778 | A1 | 4/1998 |
| GB | 2050957 | A | 1/1981 |
| GB | 2219770 | A | 12/1989 |
| RU | 2139807 | C1 | 10/1999 |
| SU | 0954304 | A1 | 8/1982 |
| WO | 03095297 | A1 | 11/2003 |

OTHER PUBLICATIONS

Navatek ETM(R) Sam Rib, U.S. Copyright, Registration No. DVH 0408, Jul. 29, 2009.

Zodiac of North America Inc., Zodiac F470 Evol 7—Black, Technical Data Sheet Rev 3, Oct. 13, 2008, pp. 1-6 http://www.zodiacmilpro.com/tds/FC470Evol7.pdf.

Michael Peters, Peters on (Fast) Powerboats (Part 2), Professional Boat Builder, Oct./Nov. 2010, pp. 56-68.

C. Chryssostomidis and M. Triantafyllou, Naval Architecture for Offshore Applications, © Nov. 1981, Chapter 4.1, http://ocw.mit.edu/courses/mechanical-engineering/2-019-design-of-ocean-systems-fall-2005/syllabus/offshore_design.pdf.

Stephen M. Hollister, Automatic Hull Variation and Optimization (Meeting of the New England Section of The Society of Naval Architects and Marine Engineers, Feb. 28, 1996, http://www.newavesys.com/hullvary.htm, pp. 1-15.

New from Ice Marine: Debut at SBS 2009, Seablade 40, Southampton Boat Show, Press Release, Ice Marine Ltd., Navatek Ltd., Sep. 11, 2009.

"Sportboat Buying Check Points No. 5: What Hull Shape is Best?", at http://www.boattest.com/Resources/view_news.aspx?NewsID=4559, Jul. 27, 2011.

Holmes, Mike, "Fishing With a Legend—The Bertram 31", Harold Wells Gulf Coast Fisherman, The Saltwater Fisherman's Magazine, at http://www.bertram31.com/legend.htm, Winter Ed. 1997.

Zhang, J., Chapter V. Ship Resistance (part 1)—PowerPoint presentation, Texas A&M University, Zachry Department of Civil Engineering, https://ceprofs.civil.tamu.edu/jzhang/oe402class/Chp5-part1.ppt, Oct. 23, 2006.

* cited by examiner

INFLATABLE WATERCRAFT WITH REINFORCED PANELS

CROSS REFERENCE TO RELATED APPLICATION

This application claims priority to 35 U.S.C. §119(e) from co-pending and commonly-assigned U.S. Provisional Application No. 61/357,946, filed on Jun. 23, 2010 by Gary Shimozono, et al., entitled "Entrapment Watercraft with Inflatable Drop Stitch," and U.S. Provisional Application No. 61/442,171, filed on Feb. 11, 2011 by Steven C. H. Loui, et al., entitled "Watercraft with Airbeams," the subject matter of both are fully incorporated by reference herein in their entireties.

GOVERNMENT LICENSE RIGHTS

This invention may have been made with Government support under Cooperative Agreement HR0011-07-2-005 awarded by the Defense Advanced Research Projects Agency. The Government may have certain rights in the invention, which may include a paid-up license in this invention and right in limited circumstances to require the patent owner to license others on reasonable terms.

BACKGROUND OF THE INVENTION

1. Field of the Invention

The present invention relates generally to the field of watercrafts, and in particular to inflatable watercrafts having hydrodynamic structures and features that are inherent in the counterpart rigid watercraft structures.

2. Description of the Background Art

Conventional rigid (hull) inflatable boats (RIBs) typically lack an advantage of inflatable watercrafts, in that the former are not foldable, collapsible, or rollable into a compact storage configuration. Instead, these conventional RIBs have large stowage volumes that limit the quantities available for multiple RIB deployment from hosts, such as ships, aircraft and land transports. Although the inflatable tubes on these RIBs can be deflated and stored in a smaller volume, the stowage footprint of the remainder of the hull cannot be significantly reduced by conventional manufacturing techniques.

While conventional inflatable boats (IBs), on the other hand, benefit from reduced stowage footprints; they, however, suffer from the drawback of not being rigid enough even when fully inflated. Instead, the entire boat can bend and deflect to uncomfortable amounts in various seaways. Additionally, with the use of conventional inflatable materials in such IBs, the required stiffness and definition in structure cannot be achieved so as to assemble a fully inflatable boat with hydrodynamic features and structures of the counterpart rigid boat, one example of such feature and structure being running strakes along the hull form.

One advantage that is associated with rigid hulls is the utilization of complex hull shapes and supporting structures which effectuate certain beneficial sea-keeping results. It would be advantageous to devise a way to achieve these hydrodynamic structures and features when assembling inflatable watercrafts. What is needed is a new approach to conventional assembly of rigid inflatable boats and inflatable boats that impart increased and variable stiffness, additional strength, redundancy, and improved buoyancy to the inflatable hull structure. Further, it would be beneficial to assemble an inflatable boat in a manner that allows for the construction of hydrodynamic hull features, such as running strakes, which, as a result, would improve the hull performance and allow for greater flexibility and control in hull design.

SUMMARY OF THE INVENTION

The present invention overcomes the deficiencies and limitations of the prior art by providing systems, apparatus, methods, computer program products and other embodiments for assembling an inflatable watercraft with reinforced panels.

An inflatable watercraft is provided with multiple panels that are configured to form a center hull having a V-form. The center hull supports a floor that is coupled to a U-form collar. The panels also form a pair of outer side hulls respectively disposed on opposite sides of the center hull and which define a tunnel between the center hull and each of the outer side hulls.

Advantages of the invention will be set forth in part in the description which follows and in part will be apparent from the description or may be learned by practice of the invention. The objects and advantages of the invention will be realized and attained by means of the elements and combinations particularly pointed out in the appended claims and equivalents.

The figures depict the described embodiments of the present invention for purposes of illustration only. One skilled in the art will readily recognize from the following discussion that additional embodiments of the structures and methods illustrated herein may be employed without departing from the principles of the invention described herein.

DETAILED DESCRIPTION OF THE DESCRIBED EMBODIMENTS

Figure 1:
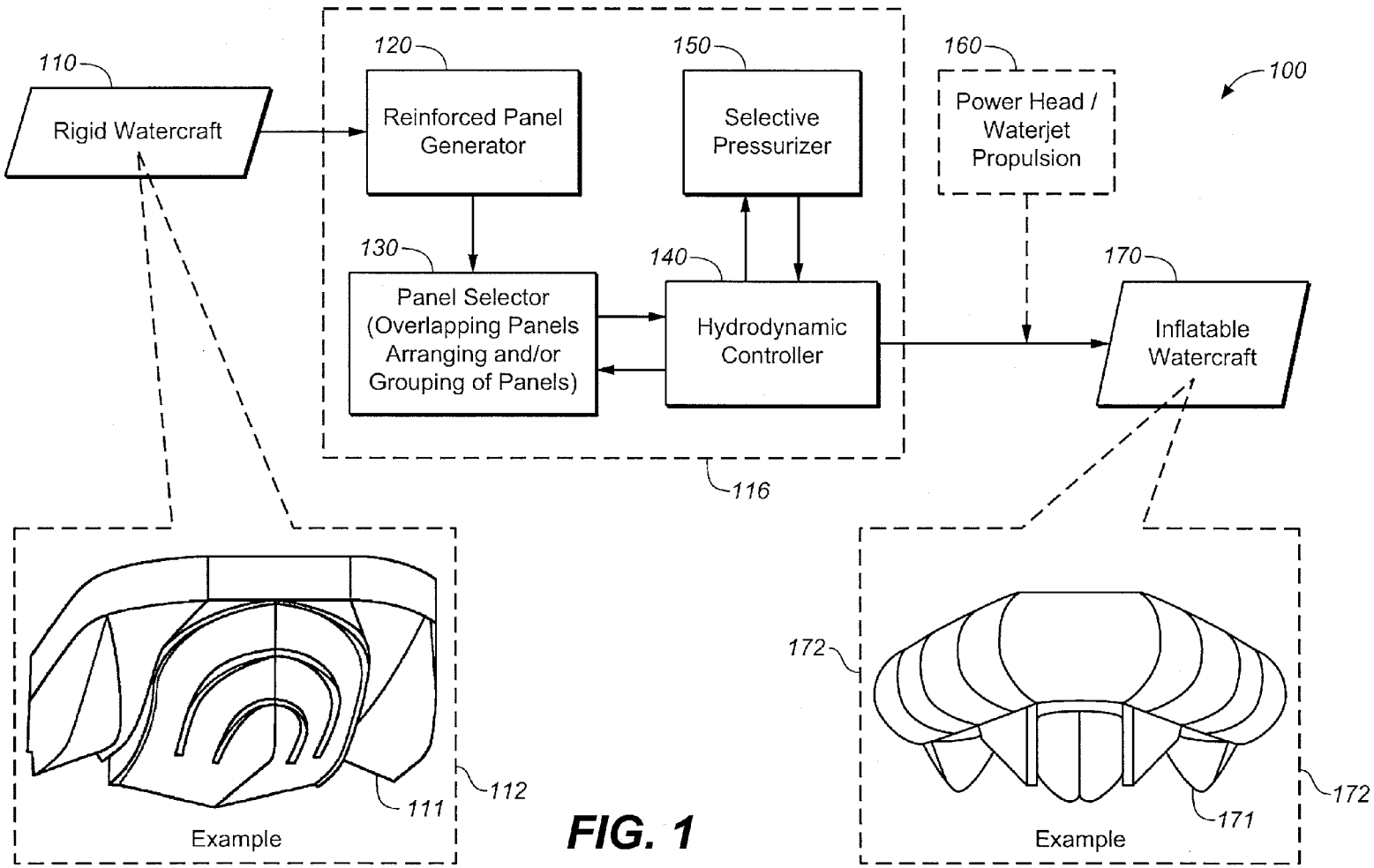
FIG. 1 illustrates a functional block diagram of an example of a system for assembling an inflatable watercraft with reinforced panels, according to at least some embodiments of the invention.

Referring now to the drawings in detail, FIG. 1 illustrates a functional block diagram of an example of a system for assembling an inflatable watercraft with reinforced panels, according to at least some embodiments of the invention. As shown, diagram 100 includes input parameters 110 of a rigid watercraft, a system for designing, assembling and manufacturing an inflatable watercraft with reinforced panels 116, power head/waterjet propulsion module 160, and output inflatable watercraft parameters 170. Input parameters 110 of a rigid watercraft is an entrapment tunnel monohull vessel 111 depicted in the callout 112, by way of example. One known rigid entrapment monohull (ETM) vessel 111 is found in U.S. Pat. No. 7,418,915, by Lorne F. Campbell, entitled "Entrapment Tunnel Monohull Optimized Waterjet and High Payload", issued Sep. 2, 2008, the subject matter of which is hereby incorporated by reference in its entirety.

System 116 includes a reinforced panel generator 120, a panel selector 130, hydrodynamic controller 140 and selective pressurizer 150. Power head/waterjet propulsion module 160 can be embodied as an engine to be included in the overall assembly of the inflatable vessel 171. As will be described in more detail beyond that shown in FIG. 1, an example of the inflatable watercraft 171 in callout 172 has many features of the rigid entrapment tunnel monohull 111. The rigid ETM vessel has certain hydrodynamic features which system 116 enables the resulting inflatable watercraft to effectuate.

Figure 12A:
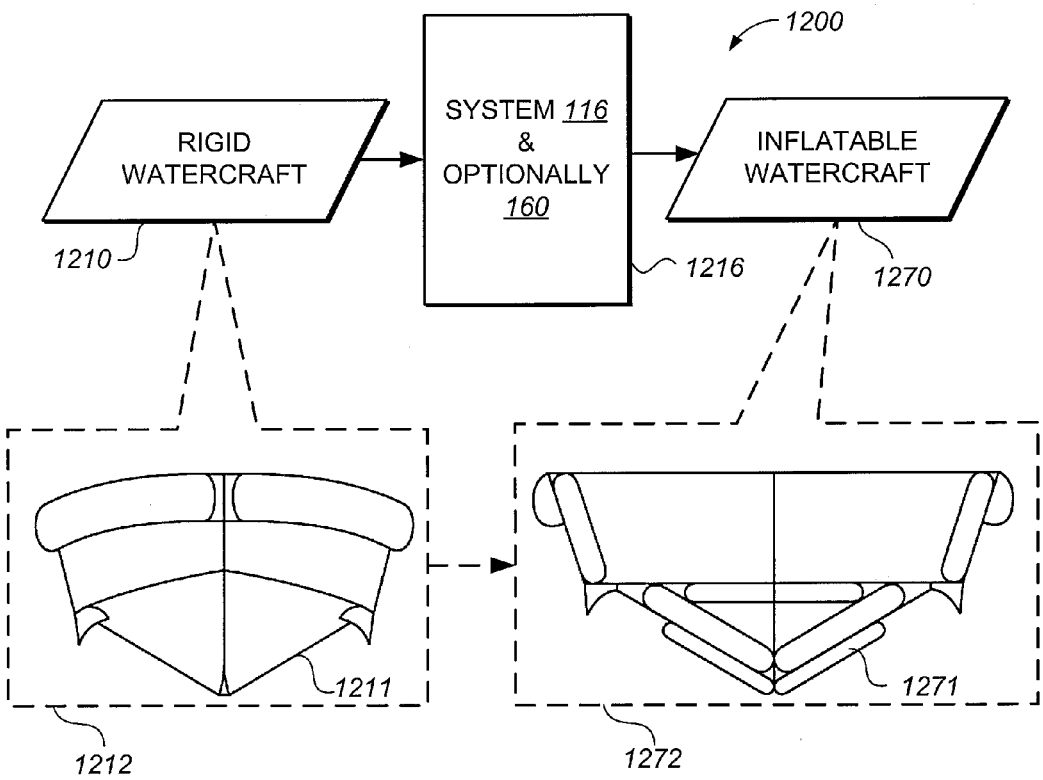
FIGS. 12A-12B illustrate a functional block diagram of an example of a system for assembling an inflatable watercraft with reinforced panels, according to further embodiments of the invention.
Figure 12B:
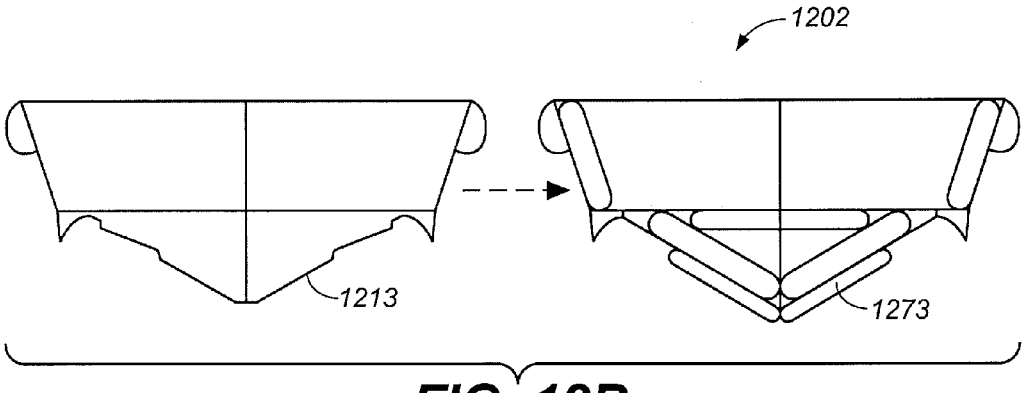

FIGS. 12A-12B illustrate a functional block diagram of an example of a system for assembling an inflatable watercraft with reinforced panels, according to further embodiments of the invention. As shown, block diagram 1200 includes system 1216 which accepts input parameters 1210 concerning desired features of a rigid watercraft, such as the watercraft 1211 indicated in callout 1212. System 1216 provides the functionality of system 116, and optionally the functionality of power head/waterjet propulsion module 160, and produces output parameters for assembling the inflatable watercraft with reinforced panels 1270, such as inflatable watercraft 1271 shown in callout 1272. FIG. 12B illustrates the stepped hull (deadrise) feature 1213 of the rigid watercraft on the left, and the inflatable watercraft 1202 with reinforced panels 1273 that effectuate this hydrodynamic feature. System 116 enables an inflatable watercraft to be designed, assembled and manufactured with multiple possible embodiments and to provide gains in operational speed, seakeeping with sea state, operational payload, reach with load carrying capacity, utility with reduced stowage footprint, and the ability to satisfy military and other applications.

Figure 2A:
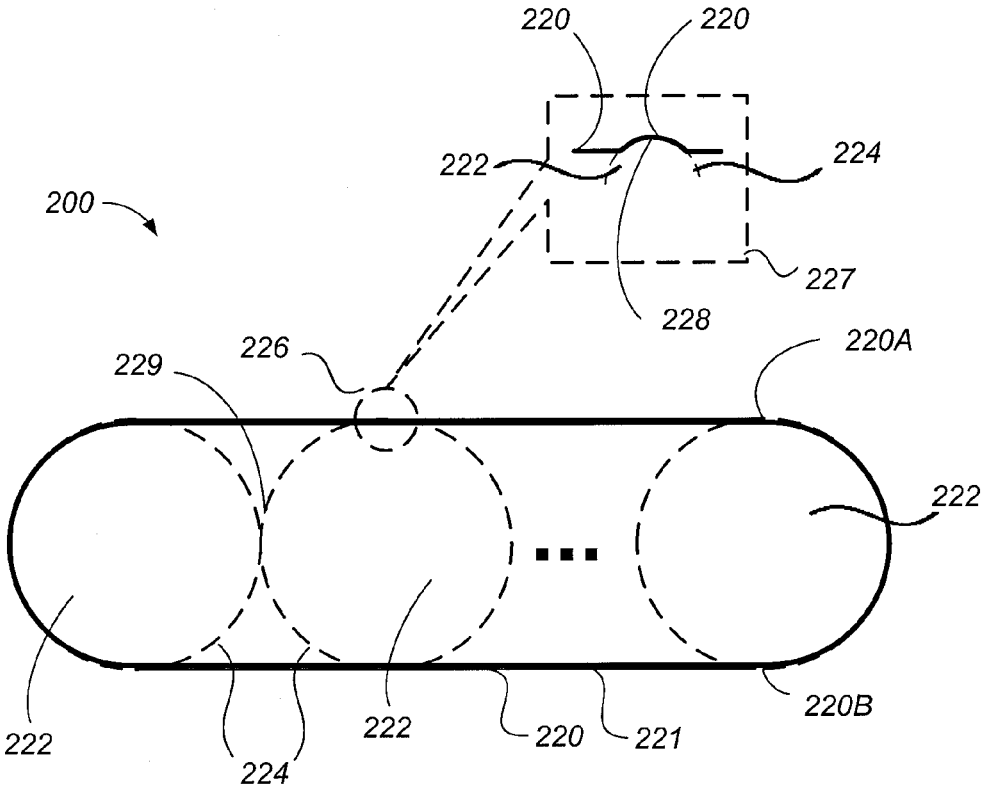
FIGS. 2A-2B illustrate close up cross-sectional views of examples of assembling and generating reinforced panels, according to at least some embodiments of the invention.
Figure 2B:
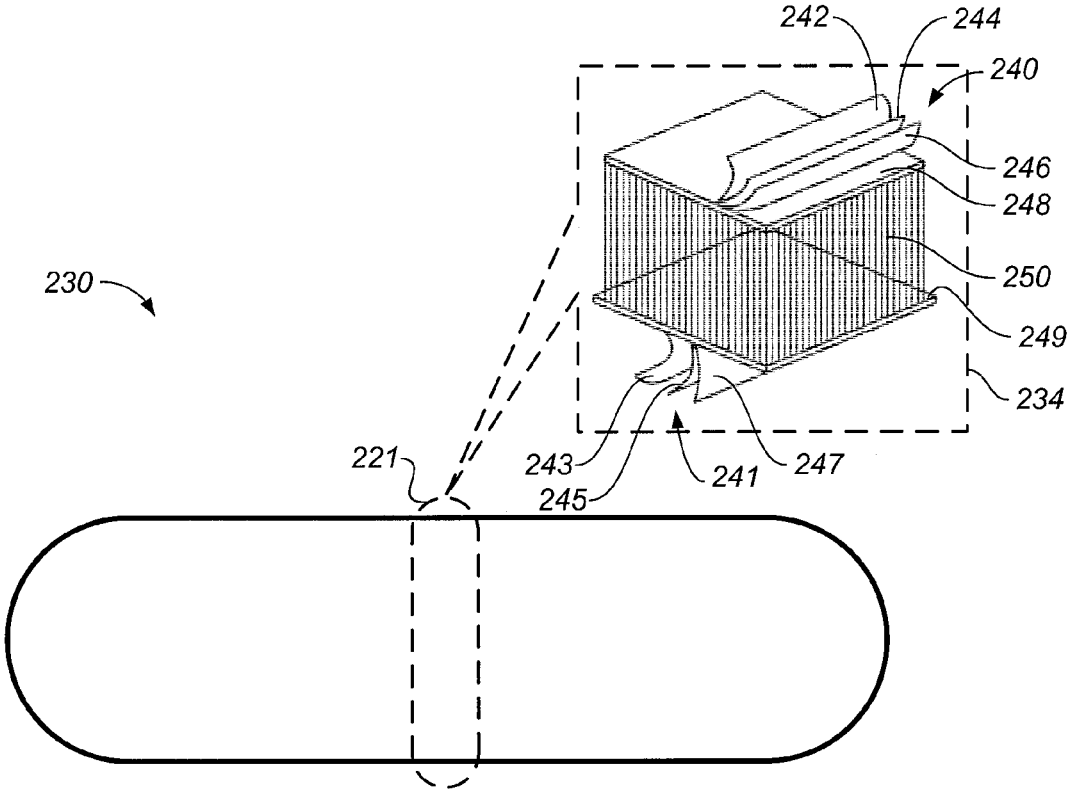

Referring to FIGS. 2A-2B, close up cross-sectional views of examples of assembling and generating reinforced panels are illustrated, according to at least some embodiments of the invention. In FIG. 2A, reinforced panel 200 includes one or more air cells 222 encased in a fabric surround 220 (also referred to as a skin fabric), both of which are constructed from a highly durable para-aramid fiber (weave), such as TurtleSkin® textile made by Warwick Mills, Inc. of New Ipswich, N.H., and coupled with a polymer coating such as polyurethane or other proprietary coating 224, 221. The combined textile or fabric has waterproof properties. When referencing detail 226 and as better seen in callout 227, air cells 222 (and coating 224) are attached 228 to skin fabric 220, which in one example is by heat sealing technique and in another example is by adhesion. It will be apparent to those skilled in the art that other known (waterproof) bonding techniques would be applicable. In some embodiments, airbeams (defined below) are similarly coupled to each other, as depicted by the reference 229 to the bonding between air cells 222. In some embodiments, air cells 222 have a fabric interwoven between each other to maintain the inflatable watercraft hull structure and shape. By way of example, air cells may vary in diameter and material, but have generally high durability and are adapted to maintain relatively high pressures and thus high stiffness for extended periods of time. In the context of using such fabric surround 220 for inflatable watercrafts, reinforcement of panels of air cells help maintain hull structure and shape in some embodiments.

It will become apparent to the skilled artisan that when viewing the cross-section of panel 200, the combination of air cells 222 and the fabric surround 220 functions as an interwoven textile and will be referred to as a web reinforced fabric or panel, where in particular, the fabric surround 220 functions as a dual-walled fabric 220A, 220B encasing air cells 222, and in so doing, provides reinforced strength, durability and stiffness. In yet other examples, it will become apparent that fabric surround 220, the material comprising air cell 222 and coatings 221, 224 are comprised of multiple layers of fabric, adhesive and protective coatings on its outermost layers of panel 200, which would provide improved resistance to puncture and abrasion. Those of ordinary skill in the art will also realize that in addition to this multiple-walled fabric surround configuration, the use of different materials would provide improved durability and resistance to high ambient temperatures. When air cells 222 are combined with the fabric support 220 as shown in FIG. 2A, this combination embodied as a panel, as will be described in further detail subsequently, offers flexibility of assembling the inflatable watercraft to effectuate (complex-shaped) hydrodynamic features of the rigid hull-form, which in turn, would achieve improved (i.e., higher) rigidity, while maintaining a low weight and low deflated volume, by comparison to the rigid hull-form counterpart. Examples of such complex-shaped features will become apparent in the further description, but generally includes the faceted-shaped features of the deadrise, whether symmetrical or asymmetrical, amas (or sponsons), hull configuration, strakes, risers, and other hydrodynamic features of the rigid watercraft.

Figure 16:
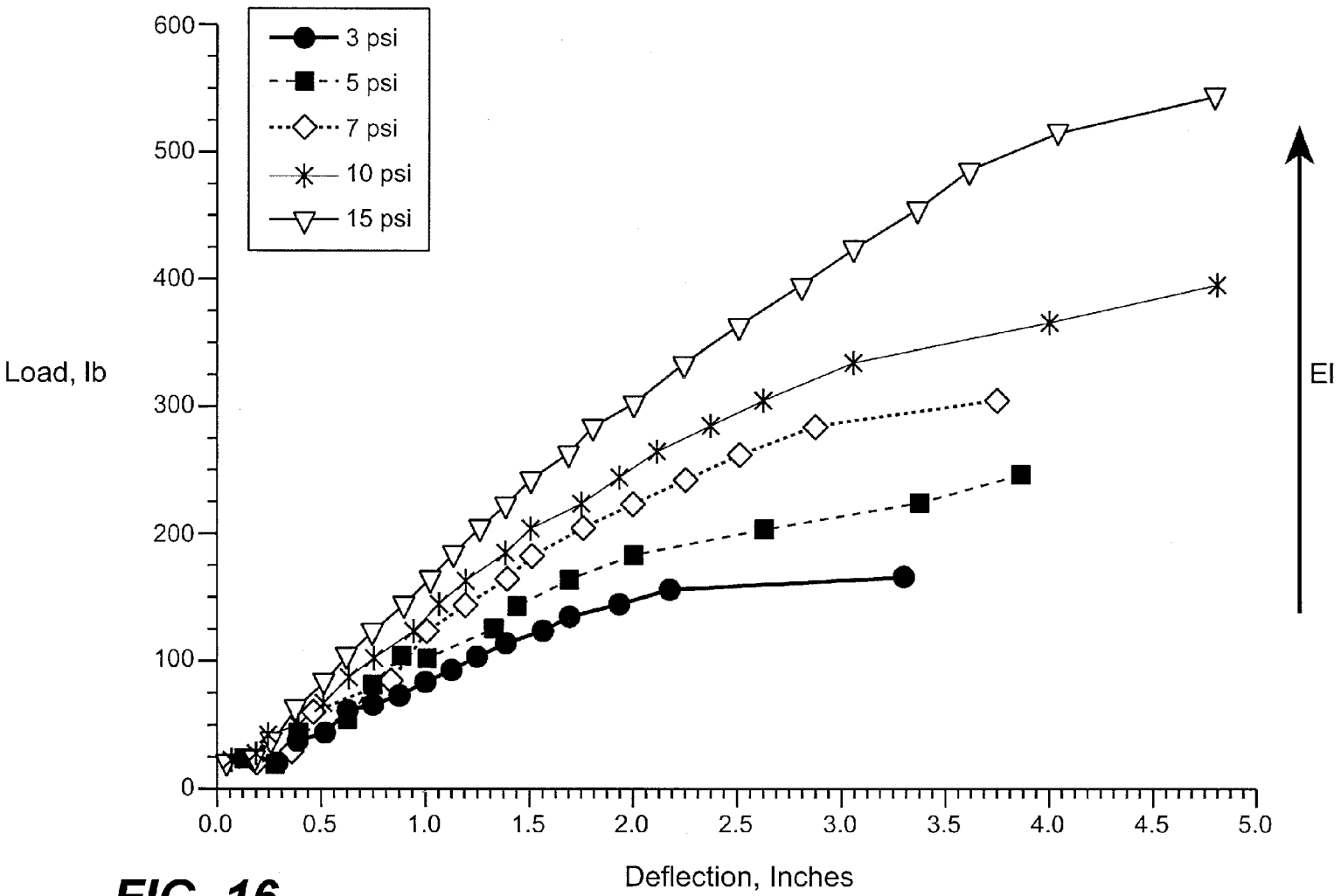
FIG. 16 illustrates a table of load measured against deflection parameters for determining the stiffness of drop stitch material, according to an embodiment.

Turning to FIG. 2B, another close up cross-sectional view of an example of assembling and generating a reinforced panel is illustrated, according to at least some embodiments of the invention. As shown, reinforced panel 230 is formed from an inflatable material 221, which one embodiment is more clearly shown in callout 234. Inflatable material 221 has multiple layers, comprises a coating 242 coupled to a fabric 244, which with adhesive 246 is coupled to fabric 248. Fabric 248, in turn, is coupled to another fabric 249 by a plurality of threads 250 anchored thereto. Fabric 249, which with adhesive 247 is coupled to fabric 245, which is coupled to coating 243. When these layers are combined in this manner, a dual-walled fabric results where wall 240 (i.e., 242, 244, 246, 248) is reinforced with threads 250 to wall 241 (i.e, 243, 245, 247, 249). When panel 230 is inflated, wall 241 and wall 240 are configured to allow the air pressure to fill the volume created where threads 250 are disposed, so that threads 250 hold the dual walls 240, 241 from completely separating. In the embodiment shown in FIG. 2B, threads 250 function as the web reinforcement of dual fabric walls 240, 241, the combination of which provides reinforced strength to inflatable material 221. At a minimum, walls 240 and 241 are waterproof. In some embodiments, inflatable material 221 is drop stitch fabric. Other suitable materials for inflatable material 221 include polyurethane drop stitch fabrics, PVC fabrics, double-wall fabrics, and other multi-wall fabrics. Commercially available multiple wall fabrics are available in 78 mm, 100 mm, 150 mm, and 200 mm thicknesses by way of examples. FIG. 16 illustrates a table of load measured versus deflection parameters for determining the stiffness of drop stitch material according to an embodiment. The amount of deflection indicates the nature of stiffness capability similar to plywood as described by some commercial manufacturers. Drop stitch fabrics and comparable technology when embodied in reinforced panels assembled into the inflatable watercraft allow the vessel to maintain hull structure and shape in some embodiments.

In general, whether the techniques for the assembly of reinforced panels shown in FIG. 2A or FIG. 2B are utilized, inflatable reinforced panels (used interchangeably with inflatable panels, reinforced panels, and panels) formed from the web reinforced fabrics disclosed allow the watercraft to be inflated to relatively high pressures, such as 15 psi. The reinforced panels comprising such materials enable the watercraft to be assembled with hydrodynamic features similar to the rigid ETM vessels. As will become apparent from the description to follow, once the reinforcement panels are generated, structural features of the rigid ETM are achieved by selecting, grouping, arranging, overlapping and/or orienting the panels shown in FIGS. 2A-2B for hydrodynamic control, and by selectively pressurizing panels and/or groups of panels. Whether the techniques discussed with reference to FIG. 2A or FIG. 2B are used, the resulting panel generated and formed from a web-reinforced fabric provides sufficiently high enough stiffness to enable the inflatable watercraft to maintain a forward speed, even if slightly deflated from optimally-designed inflation pressures, as will be described in more detail in the context of selective pressurization below.

Figure 3A:
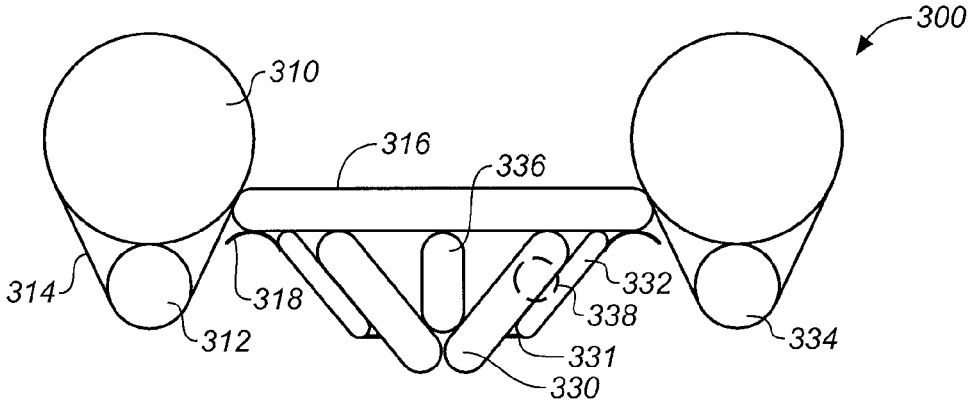
FIGS. 3A-3C illustrate transverse views taken along line A-A of the inflatable watercraft with reinforced panels in FIG. 6.
Figure 3B:
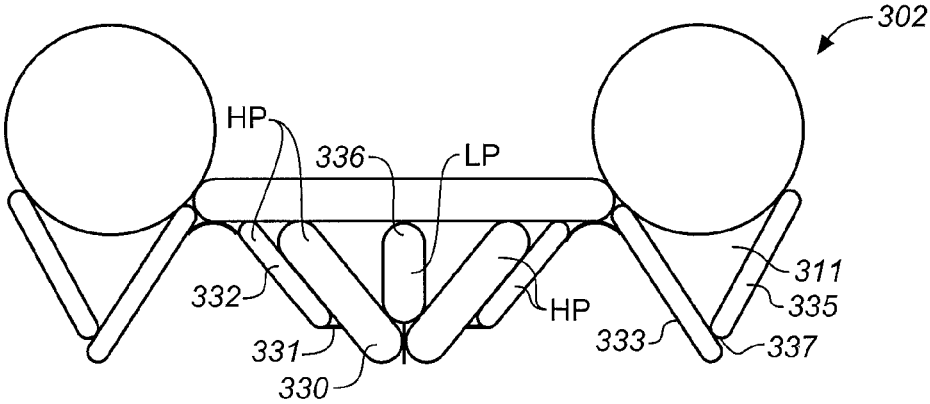
Figure 3C:
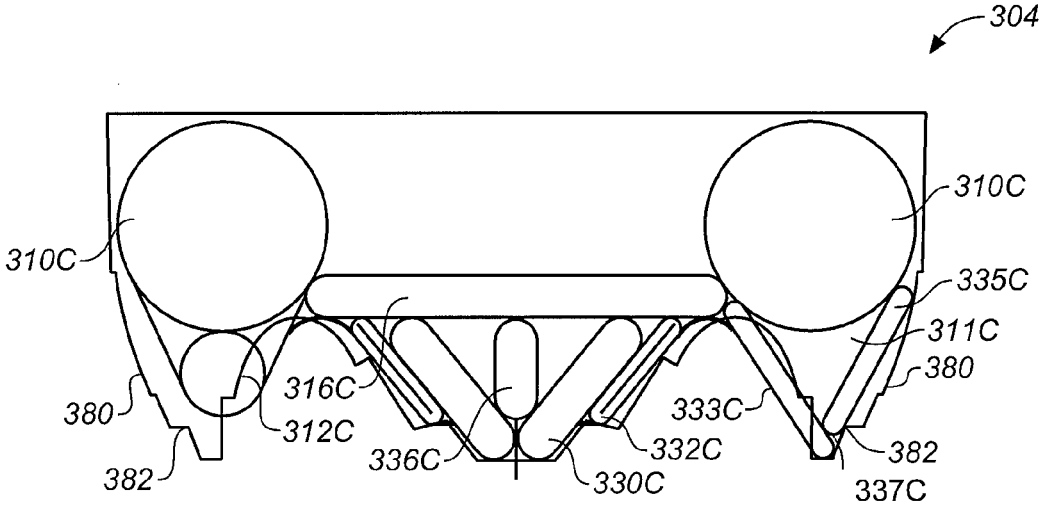
Figure 6:
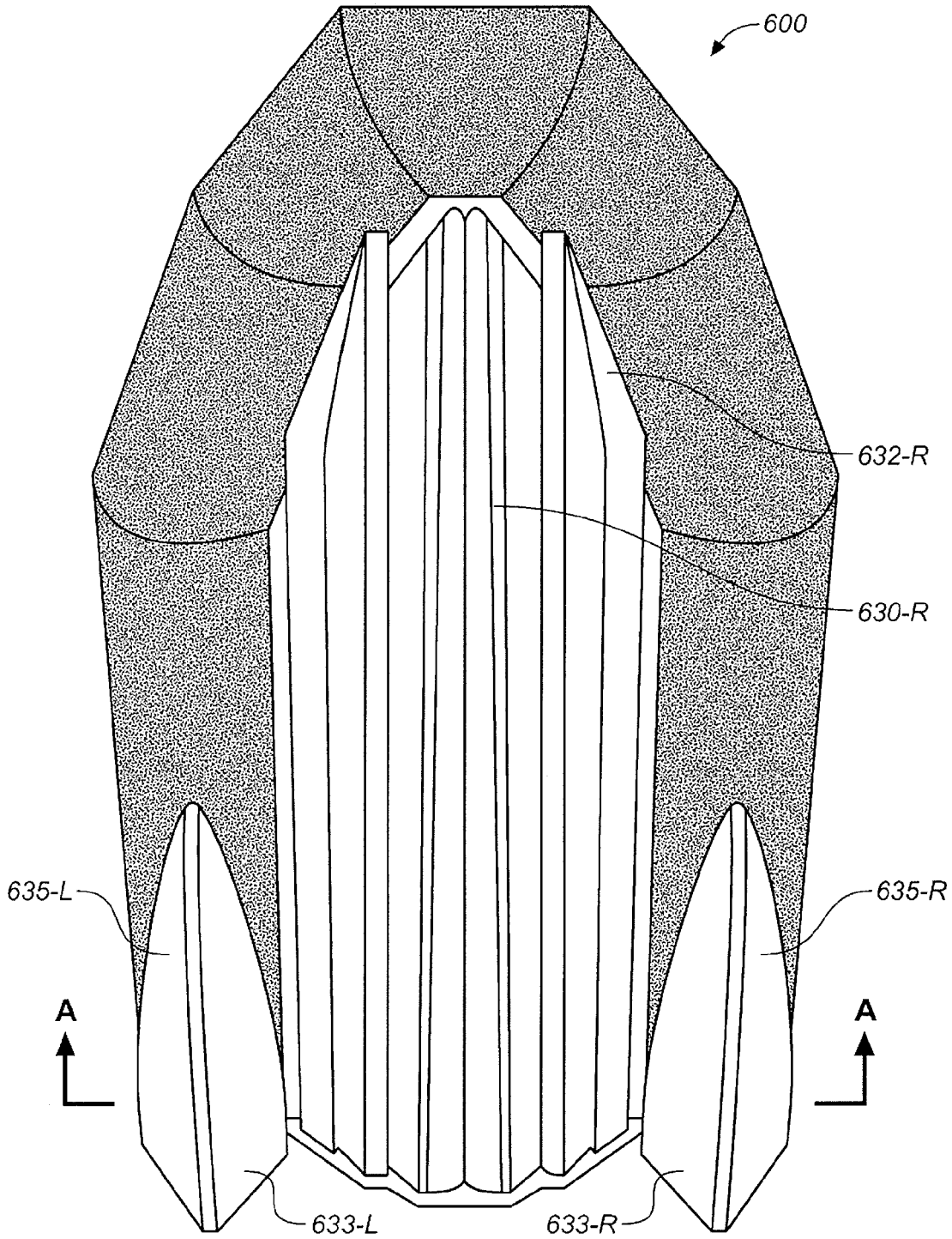
FIG. 6 illustrates a perspective view of the underside of an inflatable watercraft with reinforced panels, according to at least some embodiments of the invention.

Referring to FIGS. 3A-3C, transverse views taken along line A-A of the inflatable watercraft with reinforced panels in FIG. 6. are illustrated. It will become apparent from reviewing the figures that certain aspects of the watercraft have portions being symmetric about the main hull, and that a description about aspects on one side of the watercraft would apply to the symmetric counterpart. As seen in FIG. 3A, transverse view 300 of the inflatable watercraft shows one embodiment modeled after a rigid ETM vessel, and includes main air cell 310, airbeam forming an ama 334 depicted by air cell 312, fabric support 314 and 318, floor 316, first set of reinforced panels 330 forming the main hull with deep V-shaped configuration (also referred to as a deep-V form and v-form), second set of reinforced panels 332 forming a (deadrise) riser for stepped hull configuration, and internal support reinforced panel 336. Reinforced panels 330 overlaps 338 and is coupled to panel 332 via the techniques discussed with respect to FIGS. 2A-2B. Panels 330, 332 are depicted as being of different cross-sectional dimensions and longitudinal lengths, but in other embodiments, they may be the same. The lower edge of panel 332 is disposed relative to panel 330 so as to define strake 331, a specific hull feature of a rigid ETM vessel, and one that imparts improved performance to the inflatable watercraft. In addition to providing a running strake, the use of multiple panels (such as with 330 and 332) increases the stiffness or rigidity of the inflatable hull, by comparison to if a single panel were used to define the deep V-shaped configuration of the center (main) hull. Furthermore, the multiple panels provide additional strength, redundancy, and buoyancy to the inflatable watercraft. In other embodiments, layers of additional reinforced panels are added to form additional strakes, to change the width of a strake, and to change the overall hull stiffness, strength and volume.

In the transverse view 302 depicted in FIG. 3B, ama 311 is formed from reinforced panels 333 and 335. In this embodiment, panel 333 is disposed relative to and overlaps with panel 335 so as to define strake 337. Reinforced panel 333 functions as an inboard side of the ama 311, which is longer (cross-sectional width) than that of reinforced panel 335, which functions as an outboard side of the ama. Panels 333, 335 define a basic V-shape of ama 311 and provide support for each other.

Turning to FIG. 3C, the transverse view 304 shown represents a combination of aspects depicted in FIGS. 3A-3B for illustrative purposes. Outline 380 represents a transverse view of one embodiment of the aft portion of a rigid ETM vessel, which may be constructed from a composite or aluminum by way of examples. Outline 380 is superimposed over the transverse views of the aft portions of the inflatable watercrafts shown in FIGS. 3A-3B, and serves to illustrate how the reinforced panels discussed herein achieve the hydrodynamic features of the rigid ETM vessel. It will become apparent that the embodiment shown is illustrative because of the asymmetrical components described as follows. As shown, view 304 includes main air cell 310C coupled to floor 316C using techniques to create a watertight bond. An underlying main hull, formed from reinforced panels 330C and 332C, supports an internal support reinforced panel 336C. By way of example, although the reinforced panels shown are to be formed by the drop stitch technique of FIG. 2B, it will be understood that the panels may be formed using the techniques discussed with respect to FIG. 2A or the combination of techniques in FIGS. 2A-2B in other embodiments. The main hull has a deep V-shaped cross-section being formed from reinforced panel 330C overlapping and being coupled to panel 332C. As shown in FIG. 3C, the left ama is formed from air cell 312C coupled to the main air cell 310C and encased in a fabric surround, whereas the right ama 311C is formed from panel 333C overlapping and coupled to panel 335C. It will become evident that the strake 382 of the rigid ETM depicted in FIG. 3C is achieved by the strake 337C of the inflatable watercraft depicted in FIG. 3C.

Figure 4A:
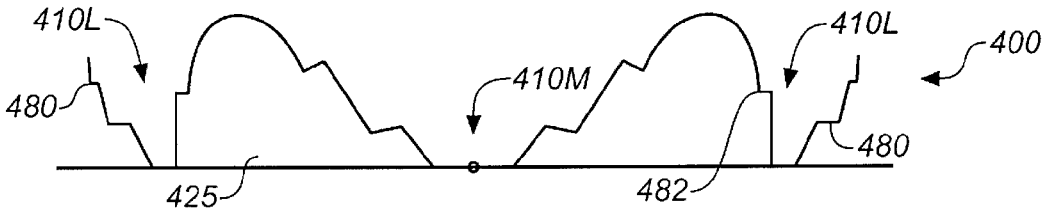
FIGS. 4A-4C illustrate transverse views take along the aft portion of another embodiment of an inflatable watercraft with reinforced panels, according to at least some embodiments of the invention.
Figure 4B:
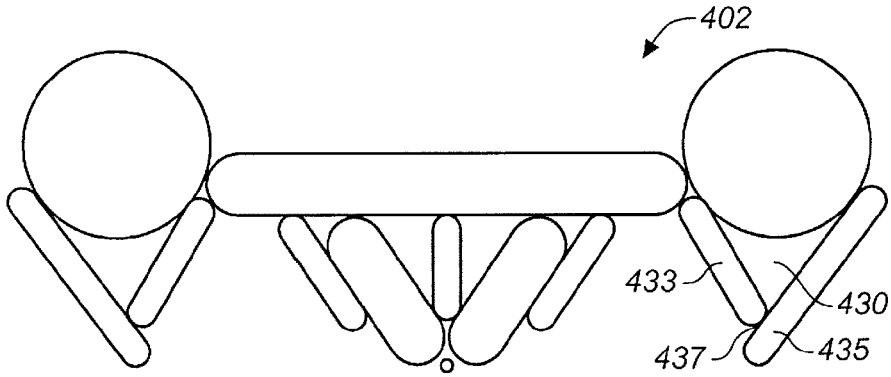
Figure 4C:
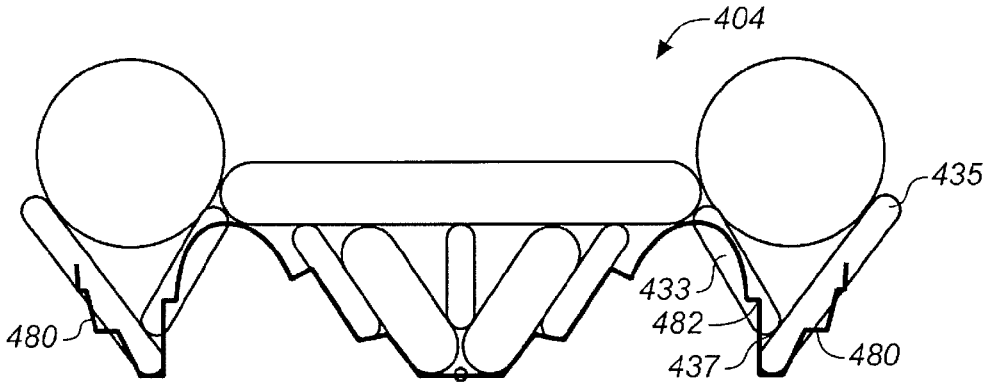

Referring to FIGS. 4A-4C, transverse views taken along the aft portion of another embodiment of an inflatable watercraft with reinforced panels are illustrated, according to at least some embodiments of the invention. In FIG. 4A, transverse view 400 depicts outline 480 representing the aft portion of a rigid ETM vessel at baseline 425, by way of another example. As shown with outline 480, a left-side ama 410L and right-side ama 410L are disposed about main hull 410M. Strake 482 is a hydrodynamic detail that is desired to be achieved in the inflatable watercraft to be assembled. In FIG. 4B, the transverse view 402 of the inflatable watercraft assembled from system 116 shows that ama 430 corresponds to ama 410L, but is formed from reinforced (inboard) panel 433 and reinforced (outboard) panel 435. Inboard panel 433 is shorter in cross-sectional dimensions than that of outboard panel 435. The lower edge of inboard panel 433 overlaps and is coupled to outboard panel 435 so as to define an inboard running strake 437 longitudinally with ama 430. Outboard reinforced panel 435 provides a surface that enables the watercraft improved turning capability and mitigates tipping of the inflatable watercraft.

Turning to FIG. 4C, the outline 480 of the rigid ETM vessel shown in FIG. 4A is superimposed over the transverse view of the aft portion of the inflatable watercraft shown in FIG. 4B, and serves to illustrate how the reinforced panels, such as panels 433 and 435, achieve the features of the rigid ETM vessel. Such feature includes running strakes 482 which are achieved on the inboard portion of each ama.

As can be seen more clearly in FIG. 6, a perspective view of the underside of an inflatable watercraft with reinforced panels, according to at least some embodiments of the invention, depicts inflatable watercraft 600 with three hulls, namely, a main hull formed from reinforced panels 630-R overlapping and coupled to reinforced panel 632-R, and a pair of amas that are symmetrically disposed outboard of the main hull. The keels of the three hulls are substantially parallel. The main hull of the inflatable watercraft has a narrow and deep V-shaped hull cross-section and configuration, and in some embodiments, includes variable rearwardly decreasing deadrise. The left ama is formed from reinforced outboard panel 635-L and reinforced inboard panel 633-L, and right ama is formed from reinforced inboard panel 633-R and reinforced outboard panel 635-R. The left and right amas have fine bows and narrow deep V-shaped hulls in some embodiments, and asymmetric deep V-shaped hulls in other embodiments. The amas start amidship and extend aft to the transom defining the tunnels on both sides of the main hull of the inflatable watercraft in combination with the sides of the main hull, the floor (in some embodiments) and inboard sides of the amas. The tunnels run to the aft half of the hull longitudinally. There is a smooth blend of hull form from forward of the inflatable watercraft to aft with no abrupt change in section. As depicted, hydrodynamic features of the rigid ETM vessel are captured by the inflatable watercraft with reinforced panels using the techniques discussed herein.

Those of skill in the art will recognize that system 116 provides a method (process) to assemble an inflatable watercraft with complicated hull structures of a rigid watercraft that provide hydrodynamic control. Additionally, the overlapping and coupling of multiple reinforced panels, whether formed from web reinforced fabrics encompassing the combination of air cells encased in a fabric surround or with drop stitch fabric, impart improved stiffness or rigidity to the inflatable hull structure than would have been otherwise achieved with a single panel of equivalent transverse widths. Additionally, selective orientation of the reinforced panels helps improve the stiffness in the inflatable watercraft structure, and provides additional strength, redundancy and buoyancy of the inflatable hull.

Figure 5:
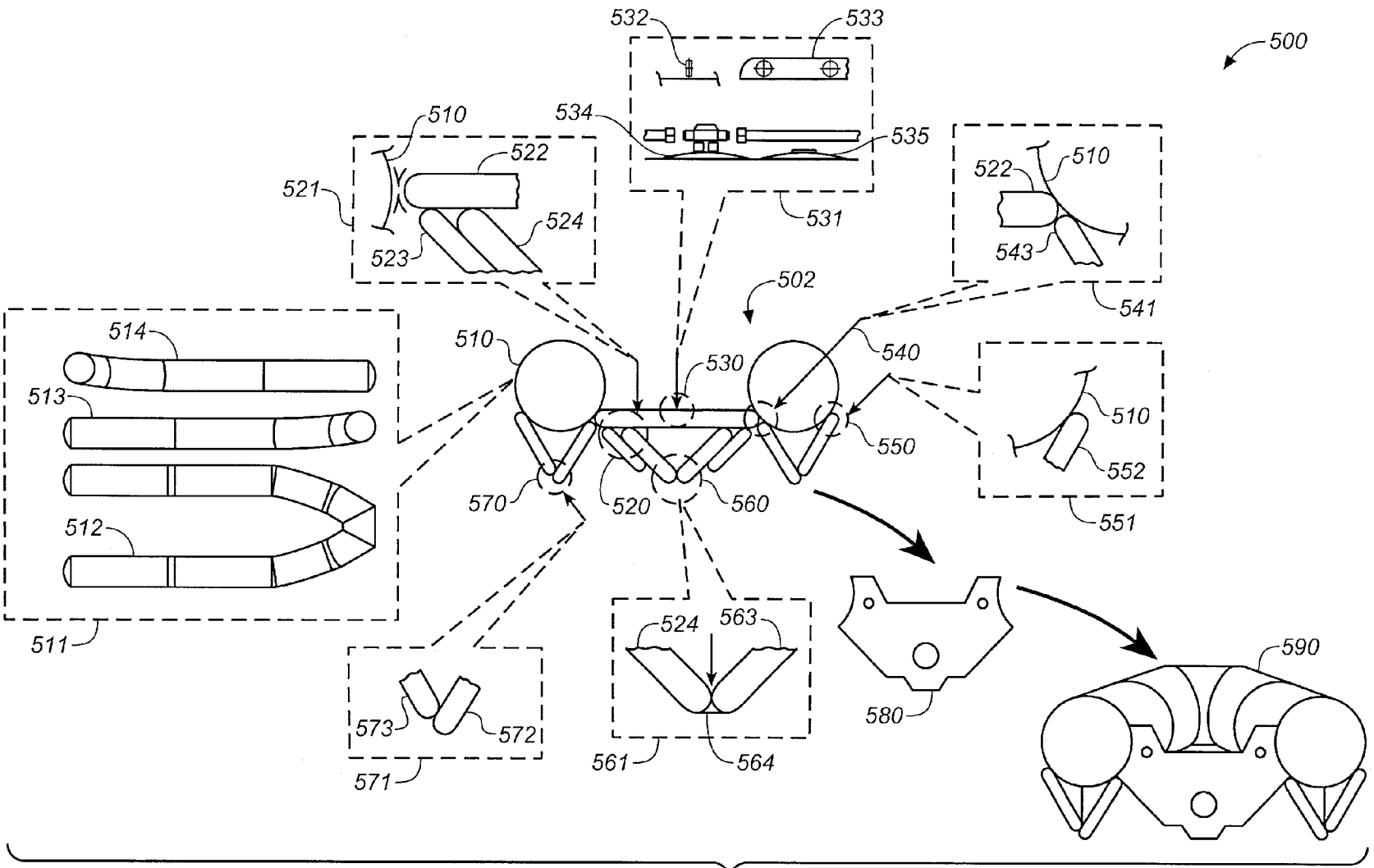
FIG. 5 illustrates a cross-sectional exploded view of certain aspects of an inflatable watercraft with reinforced panels, in accordance with at least some embodiments of the invention.

Turning to FIG. 5, a cross-sectional exploded view of certain aspects of an inflatable watercraft with reinforced panels, in accordance with at least some embodiments of the invention, is illustrated. As shown in view 500 and with more detail in callout 511, watercraft 502 includes air beams 513 and 514, which are selected, arranged and oriented in a U-shaped configuration as represented by main air cell 510, otherwise referred to as the collar of the inflatable vessel. Detail 520 is depicted more clearly in callout 521, where main air cell 510 is coupled to floor 522 so that a watertight seal is accomplished. Reinforced panel 523 and panel 524 are arranged, overlapped, grouped and coupled together to form the main hull, which has a deep V-shaped configuration. Panels 523, 524 are coupled to floor 522 via the techniques discussed with respect to FIGS. 2A-2B, or other known adhesion or bonding techniques that would enable a watertight seal. In some embodiments, the fabric surround described previously is used to also create this watertight seal between panels 523, 524 and floor 522. Detail 530 shows up close via callout 531 that mounting device 532 and bracket 533 can be used to couple additional components to floor 522. Such components vary from devices for securing payload, to a deck, to devices for mounting and securing a transom 580, and to fill-valves 534 and other components 535 to pressurize and inflate the watercraft. Callout 541 illustrates further details on coupling floor 522 to main air cell 510 and inboard reinforced panel 543 which forms part of the right ama. Detail 550 illustrates via callout 551 that outboard reinforced panel 552 is coupled to main air cell 510 by techniques described herein to achieve a watertight seal. Referencing detail 570, callout 573 shows that outboard reinforced panel 573 is overlapped and coupled with inboard reinforced panel 572 to form the left ama. In detail 560, and as shown more clearly in callout 561, reinforced panels 524 and 563 are oriented in a deep V-shaped configuration and coupled together to form the main hull.

Transom 580, to which an outboard motor can be attached in some examples, is the only sizeable rigid component coupled to the inflatable watercraft. In some embodiments, transom 580 can impart support to the inflatable watercraft, its structure and rigidity of the remainder of the inflatable vessel being attained from the configuration and orientation of air beams, overlapping of reinforced panel to achieve hydrodynamic control, and selective pressurization of panels or groups of panels, the combination of such enabling interaction between each component to achieve hydrodynamic features and structures of the rigid ETM vessel. When fully assembled, the resulting inflatable watercraft with the reinforced panels described herein is shown as watercraft 590.

Referring back to FIG. 3B, selective pressurization of panels and/or groups of panels will be discussed. The use of web reinforced fabrics embodied as inflatable reinforced panels, whether via the combination of air cells and surround fabric described with regard to FIG. 2A or drop stitch fabric described with regard to FIG. 2B, enables the stiffness of each panel to be varied selectively by controlling the inflation pressure, in addition to varying the cross-sectional width of a reinforced panel, the longitudinal length of the panel (airbeams) and materials utilized. Panels with identical or varying stiffness, in some embodiments, are selectively grouped and arranged in multiple layers so as to interact with each other and satisfy various design requirements.

As depicted in FIG. 3B, and by way of example, the reinforced panels 330 and 332 that are arranged and overlapped to form the deep V-shaped configuration of the main hull are inflated to higher pressures and made stiff in one example to preserve the integrity of the shape of the inflatable hull and to achieve planning efficiency. Contemporaneously and additionally, the reinforced panel forming the internal support structure 336 is inflated to a lower pressure and made more compliant so as to enable shock absorption and cushioning effects, which along with high pressurized panels 330, 332, results synergistically in improved ride comfort for crew in violent sea states. The designation "HP" in FIG. 3B indicates such higher pressure, while the designation "LP" indicates such lower pressure. By way of examples, for portions of the inflatable watercraft that require a higher stiffness, the corresponding panel or group of panels are filled with air at 15-20 psi, while for more compliant portions of the watercraft, the corresponding panel or group of panels are filled with air at 3-5 psi. In addition to the example discussed with FIG. 3B, it will become apparent that an inflatable watercraft with a reinforced panel or group of reinforced panels with identical or varying stiffness, in other embodiments, can be selectively grouped and arranged in multiple layers to interact synergistically so as to achieve hydrodynamic control similar to that of the rigid vessel, and to maintain critical ETM hull form while also providing shock absorption and cushioning effects.

Those skilled in the art will understand that the reinforced panels assembled from the web reinforced fabrics described can be equipped with fully integrated, single-point inflation capability to fill isolation-capable chambers. Additionally, multiple inflation points are possible in some examples. The panels may be pressurized using a manifold system having a single air input in one embodiment, and multiple inputs in others. In one example, fill-valve 534 is mounted to floor 522 in FIG. 5. In other examples, air input components can be disposed at other locations about the inflatable watercraft, to enable selective variation of inflation pressure so as to reduce vertical accelerations and to improve ride quality of the vessel.

Figure 7A:
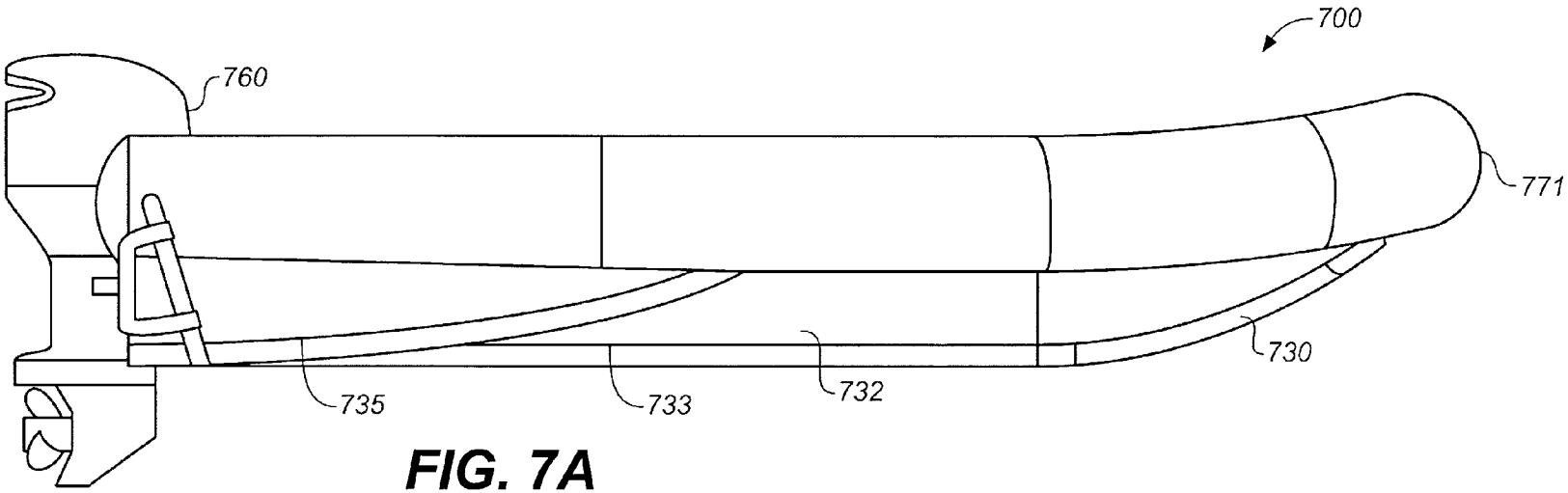
FIGS. 7A-7B illustrate side elevations of a fully deployed and rolled-up inflatable watercraft with reinforced panels, respectively, according to at least some embodiments of the invention.
Figure 7B:
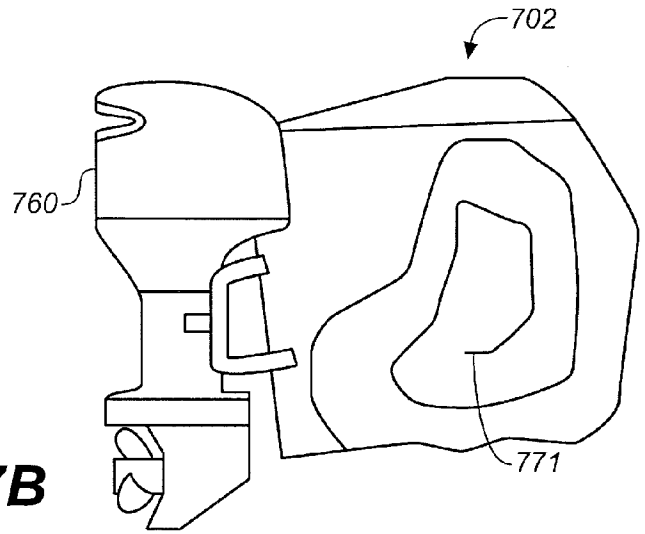

FIGS. 7A-7B, illustrate side elevations of a fully deployed and rolled-up inflatable watercraft with reinforced panels, respectively, according to at least some embodiments of the invention. As shown in FIG. 7A, ETM inflatable watercraft 700 is referenced by bow 771 formed from a main beam (inflatable collar), and includes reinforced panels 730 functioning to form the main hull, reinforced panels 732 overlapped with panel 730 to effectuate a stepped hull configuration and enabling the formation of strake 733 (both hydrodynamic features of the rigid ETM vessel in this example), and outboard reinforced panels 735 configured to form the ama when combined with inboard reinforced panels (not shown in this figure). The ETM inflatable watercraft 700, which in one embodiment, is formed from drop stitch material or similar fabric discussed with respect to FIG. 2B, or alternatively from the combination of the air cell and surround fabric techniques discussed with FIG. 2A. One example of the length for the inflatable watercraft 700 is 15 feet (i.e., 5 meters), which is optionally powered by device 760, for example, a single 55 outboard motor. With this example, the inflatable watercraft achieves at least 20 knots in 4-foot seas, has range of 20-40 nmi, is configured to carry payloads of 1000 lbs (exclusive of fuel), has weight approximately 350 lbs (preferably exclusive of engine and fuel), and is deployable from a dry dock shelter. Those of skill in the art will realize that the inflatable watercraft of such an example is scalable from 4.5 to 7 meter lengths. The watercraft 700 enables the ability to transport large payloads on plane, useful for maritime security and commercial applications.

As shown in FIG. 7B, when the inflatable watercraft 700 is deflated, it can be rolled into a compact form 702 for stowage, where bow 771 is substantially rolled into a configuration with smaller watercraft footprint. Other methods of folding the deflated watercraft into a stowage form 702 will be readily ascertainable by those skilled in the art. Panels formed from air cells with fabric surround, drop stitch material, or compatible technology enable stiff panel construction with the flexibility of enabling a lightweight deflated vessel for compact stowage volume. In some embodiments, inflatable portions of the watercraft are deflated by at least 50% to permit multiple vessels in stowage form 702 to occupy the footprint and volume of a rigid inflatable boat of the prior art.

The inflatable ETM hull form depicted in FIG. 7A, assembled by system 116 described herein, provides gains in operational speed and maneuvering with sea state (i.e., improved seakeeping at high speeds in higher sea states) and improved load carrying capability than traditional deep V-shaped inflatable boats. Further, the web reinforced fabrics described with respect to FIGS. 2A-2B enable a reduced stowage volume, the ability to achieve shock absorption properties which can be varied with inflation pressure to reduce vertical accelerations, thus improving ride quality in a seaway. The high-performance inflatable watercraft has improved higher-speeds in a seaway with reduced vertical accelerations, and improved compact configuration for stowage onboard larger combatants. In a military application, this would allow the inflatable watercraft to reach its destination in less time and with decreased violent ride-environment in various sea states for the crew.

Figure 8A:
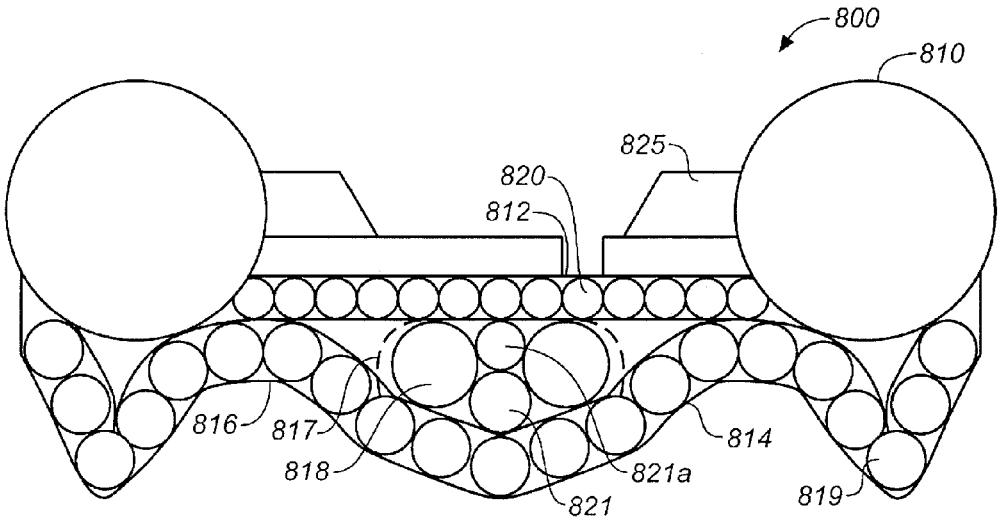
FIGS. 8A-8B illustrate transverse views of the aft portion of inflatable watercrafts with reinforced panels, according to at least some embodiments of the invention.
Figure 8B:
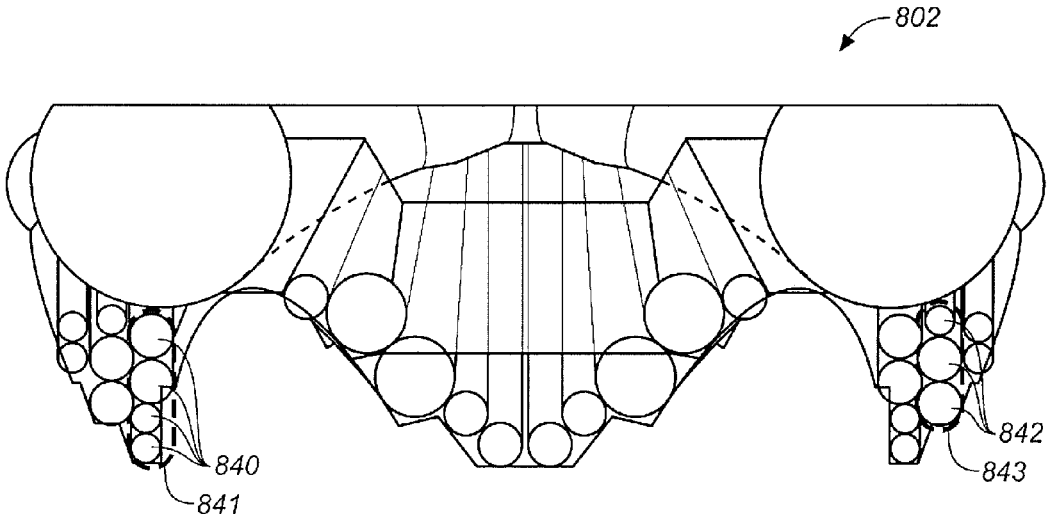

Referring to FIG. 8A, a transverse view of the aft portion of inflatable watercrafts with reinforced panels, according to at least some embodiments of the invention, is illustrated. As shown, inflatable watercraft 800 includes a main air cell 810, floor 812, underlying hull 814, and internal support structure 817 collectively assembled from a plurality of air cells 810, 818-821*a*. Air cells refer to the cross-sectional view of an air beam, which is an inflatable tubular member shown in more detail in FIG. 8B. Reference to an airbeam inherently means the longitudinal characteristic of the inflatable tubular member unless some other orientation is specified. This is seen more clearly in FIG. 8B. As shown, by way of example, four airbeams 840 are selected, grouped and arranged using the technique described in FIG. 2A, wherein a fabric surround encases all four air beams 840 to form a panel 841 (4 air cells). Similarly, and mentioned for illustrative purposes, the 3 air cells 842 are selected and encased in fabric surround (described in FIG. 2A) so as to be configured to function as a reinforced panel 843.

Turning back to FIG. 8A, the air cells 820 have similar cross-sectional diameters for floor 812. Additionally, air cells 819 have similar diameters for underlying hull 814. However, the air cells 818, 821, 821*a* of internal support structure 817 have varying cross-sectional diameters. The air beams have varying longitudinal lengths to achieve the desired structural and hydrodynamic features of the inflatable watercraft 800. In some embodiments, the airbeam may comprise varying materials.

In the embodiment shown in FIG. 8A, main cell 810 is a cross-sectional representation of a main airbeam, which has the largest cross-sectional diameter. Air cell 810 forms the hull collar that provides buoyancy for the inflatable watercraft 800, that is, when coupled to a floor 812 of the vessel. The air cells (encased within fabric surround and embodied as panels) amongst floor 812, underlying hull 814, and internal support structure 817 have different cross-sectional diameters, as they are arranged to form a specific shape of the watercraft, and selected to achieve particular hydrodynamic and structural properties. Although a longitudinal arrangement is shown for the airbeams, alternatively, they may be arranged at an angle relative to the longitudinal axis of the inflatable vessel 800 in other embodiments. In FIG. 8A, the air cells are grouped together and arranged in multi-layered or stratified assemblies. For example, floor 812 comprises a group of air cells 820 arranged in a horizontal plane that functions as one assembly and is well-suited for configuration as a reinforced panel with fabric surround. By contrast, underlying hull 814 can comprise multiple panels of air cells 819 that collectively function as still an additional assembly (this can be seen conceptually in FIG. 3B). Various spans of air cells 819 can be selected, grouped, overlapped and assembled as panels to create the faceted configuration of the amas and main hull form that has a deep V-shaped configuration and tunnels. To this end, the air cells 819 of underlying hull 814 can be further encased in shorter cross-sectional panel widths of support fabric instead of the contiguous (shown) flexible skin 816, and in some examples, are interwoven with a similar flexible material. In some embodiments, flexible skin 816 is a flexible fabric or supporting material, that when deflated, enables the watercraft 800 to be rolled or folded into a smaller footprint for transport and/or stowage.

While reinforced panels can be flat in some embodiments, with the internal support structure 817, the combination and arrangement of different-sized air cells 818, 821, 821*a* within the fabric surround can form a panel with multiple layers of air cells, where its cross-sectional dimensions are asymmetrical. Furthermore, internal support structure 817 comprises yet another group of air cells that function as an additional assembly. The air cells 818, 821, 821*a* of internal support structure 817 are depicted with 3 different cross-sectional diameters, and when inflated to a lower pressure than air cells 819, enable internal support structure 817 to provide shock absorption properties when the watercraft 800 is in variable sea states.

Transom 825 is a rigid member that is used in conjunction with the embodiment shown in FIG. 8A to allow for attachment of propulsion devices, such as an outboard motor, in some applications. Transom 825 is also used to impart stiffness to the inflatable watercraft 800, and/or to define a space in cooperation with the collar (main air cell 810) and floor 812 useful for payload and transport stowage and crew transport.

Figure 9:
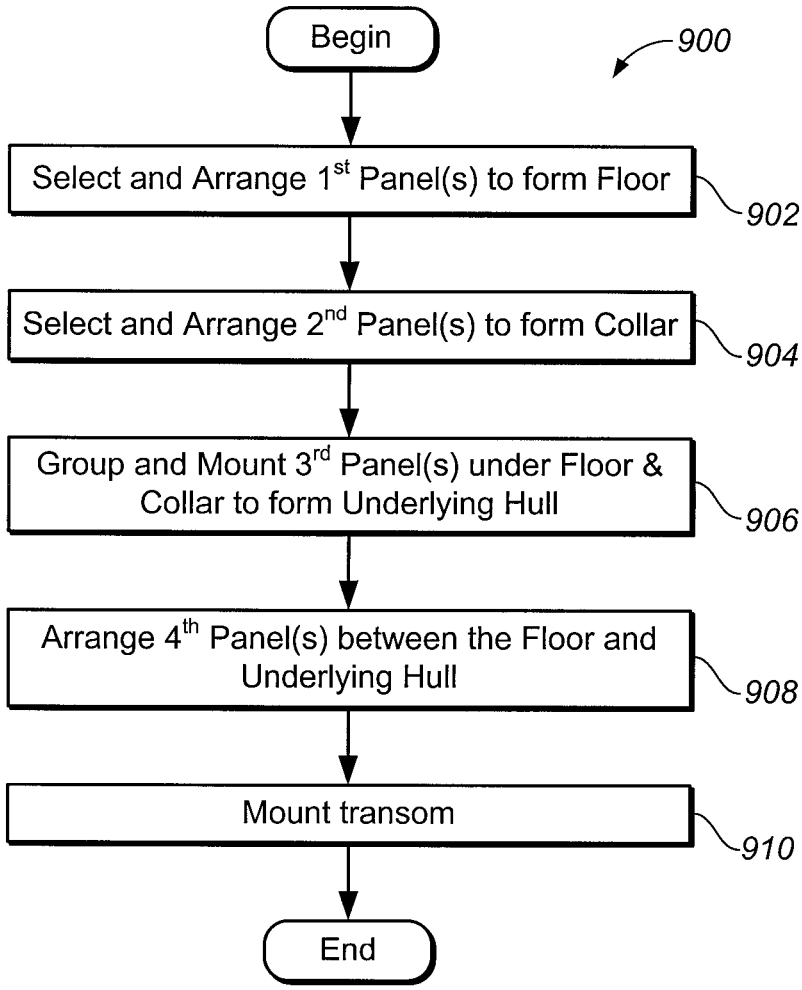
FIG. 9 illustrates a flowchart representing examples of panel selection, according to at least some embodiments of the invention.

FIG. 9 illustrates a flowchart representing examples of panel selection, according to at least some embodiments of the invention. When discussing the method of panel selection 900 as one embodiment of panel selector 130 (see FIG. 1), FIGS. 5 and 8A may be referenced for illustrative purposes. At 902, a first set of panel(s) are selected, grouped and arranged to form a floor, such as floor 812. At 904, a second set of panel(s) are selected, grouped and arranged to form a collar. If a main air cell 810 is used for the collar, then the panel comprises 1 air cell encased in fabric support (according to the method and apparatus of FIG. 2A). By way of example and referencing FIG. 5, airbeams 513 and 514 are oriented to form collar 512 which is embodied in a U-shape. At 906, a third set of panel(s) are selected, grouped and mounted under collar 810 and floor 812 to form underlying hull 814. The air cells 819 can be selected, grouped, arranged and overlapped together to form reinforced panels that achieve the faceted configuration of the amas and deep V-shaped configuration of the main hull and mounted to the floor and collar. At 908, a fourth set of panel(s) are selected and arranged between the floor 812 and the underlying hull 814. As shown in FIG. 8A, there are a total of 4 air cells forming internal support structure 817, and comprising air cells with 3 sizes of cross-sectional diameters. In one embodiment, all 4 air cells can be encased in fabric surround to form a panel. In another embodiment, the 2 smaller diameter air cell may be encased in fabric surround to form a panel disposed between the 2 air cells with larger sized cross-sectional diameters. It will become apparent that there are multiple embodiments for forming and arranging reinforced panels given the 4 air cells of internal support structure 817 and depending upon the hydrodynamic feature of interest. At 910, the transom 825 is mounted to the watercraft 800.

Figure 10:
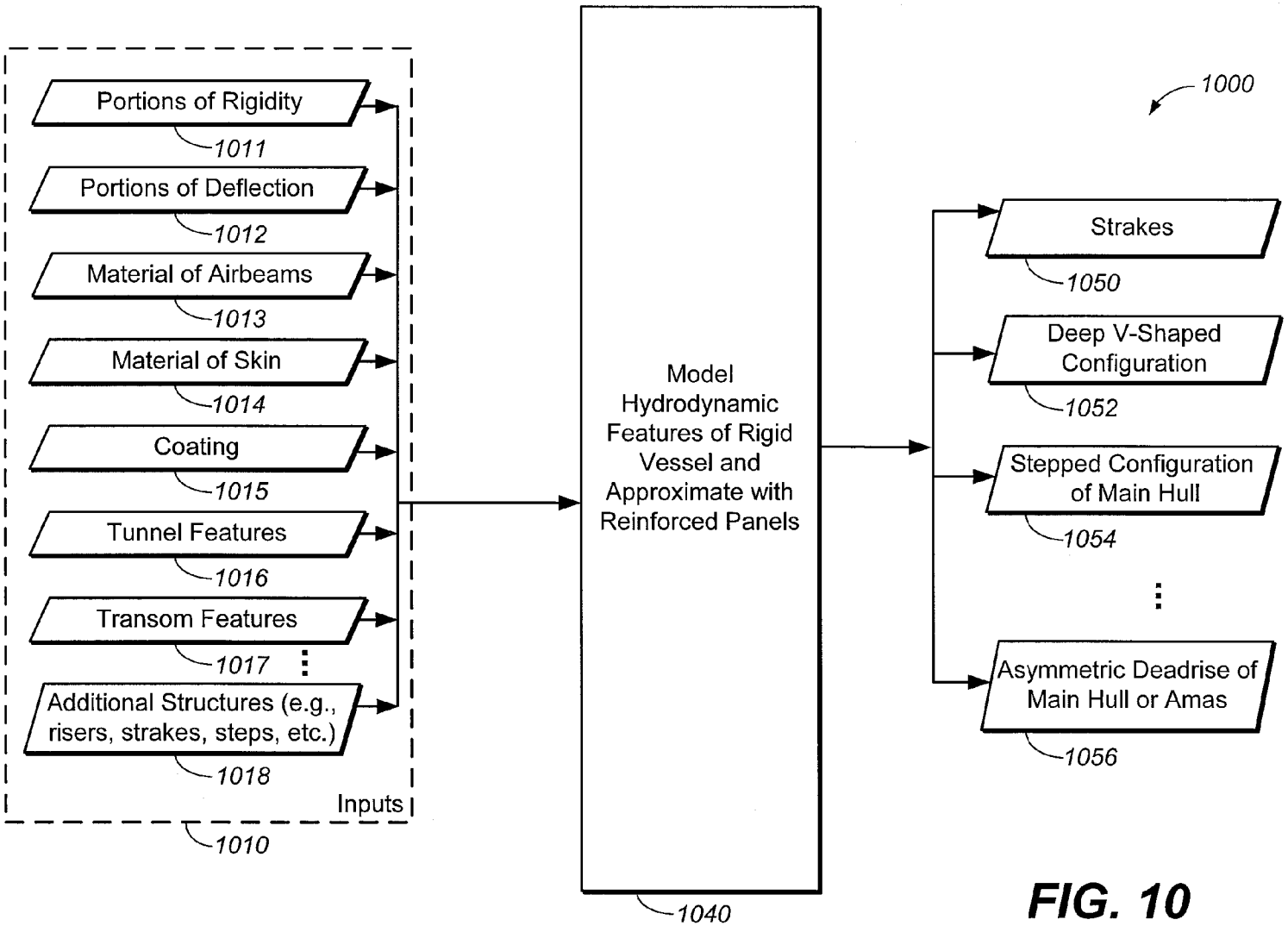
FIG. 10 illustrates a flowchart representing examples of hydrodynamic control, according to at least some embodiments of the invention.

FIG. 10 illustrates a flowchart representing examples of hydrodynamic control, according to at least some embodiments of the invention. Flowchart 1000 depicts various inputs 1010 concerning the hydrodynamic features of the rigid ETM watercraft that are of interest. Examples of such features that may be desired to be achieved in the resulting inflatable watercraft, include, portions of rigidity 1011, portions of deflection 1012, material of airbeams 1013, material of the fabric surround 1014, coating for reinforced panels 1015, tunnel features 1016, transom features 1017, and additional structures 1018 (including risers, strakes, stepped hull configuration, and airways by way of examples). At 1040, the hydrodynamic features of the rigid vessel are modeled and the configuration and arrangement of the reinforced panels are adjusted to achieve such features in the inflatable watercraft, according to one embodiment of hydrodynamic controller 140 (of FIG. 1). In another embodiment of hydrodynamic controller 140, at 1040, the cross-sectional profile of the rigid watercraft is superimposed over the cross-sectional profile of the inflatable watercraft to identify portions where such hydrodynamic features can be effectuated. This embodiment is similar to that shown in FIGS. 3C and 4C. Once these hydrodynamic features are identified, they can be implemented with the reinforced panels previously described. By way of examples, such features to be implemented in an inflatable watercraft includes strakes 1050, deep V-shaped configuration of the main hull 1052, stepped configuration of the main hull 1054 and an asymmetric deadrise for the main hull and/or amas 1056.

Figure 11:
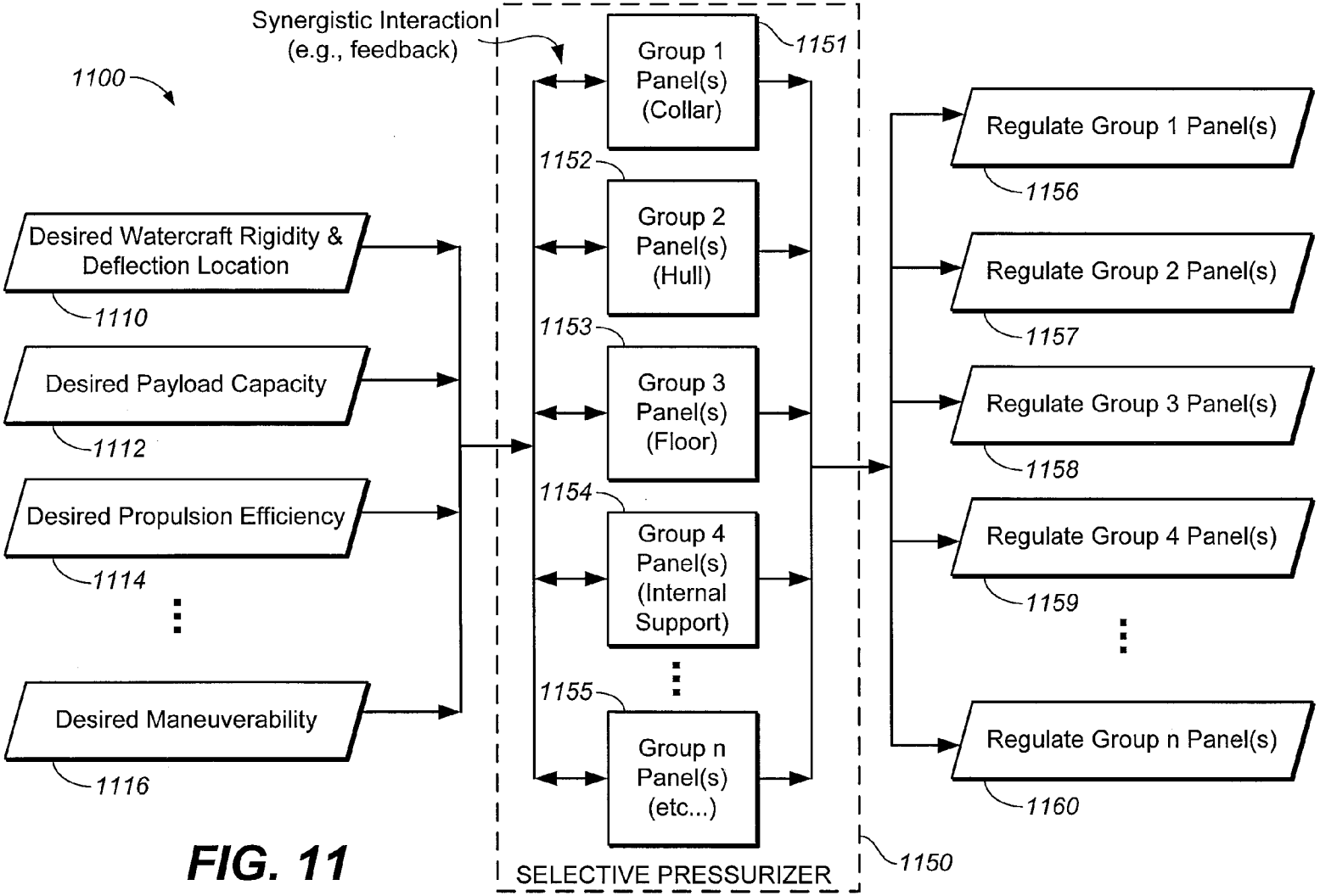
FIG. 11 illustrates a flowchart representing examples of selective pressurization, according to at least some embodiments of the invention.

FIG. 11 illustrates a flowchart representing examples of selective pressurization, according to at least some embodiments of the invention. Flowchart 1100 depicts various inputs that could affect the pressurization of a panel and/or group of panels, relative to other panel(s) or groups of panels. Examples of these inputs include the desired inflatable watercraft rigidity and locations for deflection 1110, payload capacity 1112, propulsion efficiency 1114, and maneuverability 1116. At 1150, one embodiment of the selective pressurizer 150 (of FIG. 1) is shown, and includes the consideration of synergistic interaction amongst a panel or group of panels, such synergistic interaction being provided by feedback loop identified. At 1151, a first group of panels is identified. As an example, this would be the main air cell 810 or collar in FIG. 8A. At 1152, a second group of reinforced panel(s) is identified and feedback with the first group is analyzed based upon the inputs 1110-1116. As an example, synergistic interaction between the main air cell 810 and the underlying hull 814 is analyzed to determine whether the main air cell 810 should be pressurized differently than the underlying hull 814. At 1153, a third group of reinforced panel(s) is identified and feedback with the first and second groups is analyzed based upon the inputs 1110-1116. As an example, synergistic interactions between the main air cell 810, the underlying hull 814 and the floor 812 are analyzed to determine whether the main air cell 810, underlying hull 814 and/or floor 812 should be pressurized differently. At 1154 through 1155, the next group of reinforced panel(s) is identified and feedback with the previous groups are analyzed based upon the inputs. As an example synergistic interactions between the main air cell, underlying hull 814, floor 812 and internal support structure 817 are analyzed to determine whether any of these groups of panels should be pressurized differently. Once the selective pressurizer 1150 has determined which panels or groups of panels would need to be inflated at different pressurization levels, the appropriate group is regulated as indicated by 1156-1160. As more clearly depicted in FIG. 3B, the internal support reinforced panel 336 is inflated to a lower pressure than the underlying hull comprising panels 330 and 332. The synergistic interaction in the example of FIG. 3B entails internal support panel 336 being more compliant for shock absorption functionality, and panels 330 and 332 being inflated to a higher pressure to provide rigidity and stiffness to the hull structure of the watercraft.

Figure 13A:
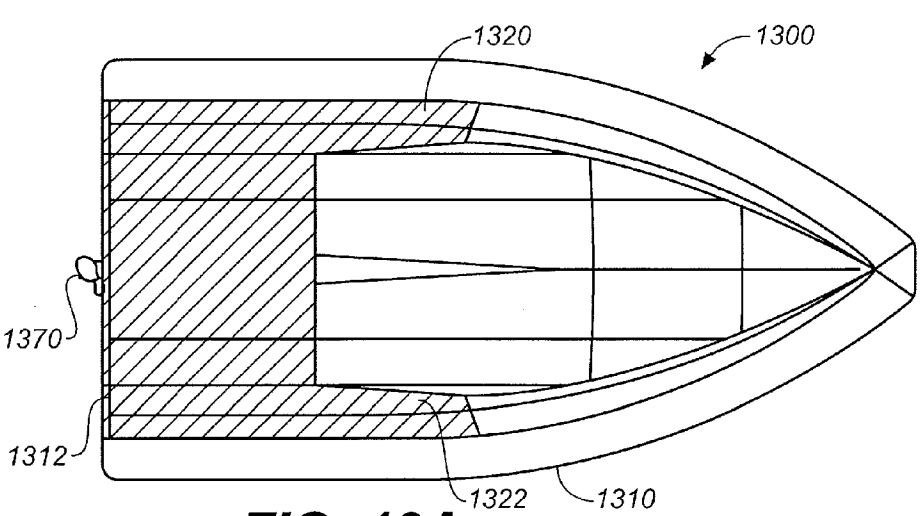
FIGS. 13A-13D illustrate bottom and side elevations of another example of an inflatable watercraft with reinforced panels, according to yet further embodiments of the invention.
Figure 13C:
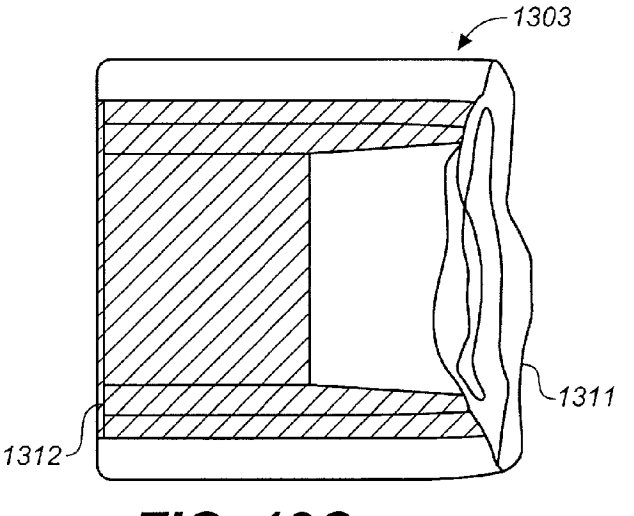
Figure 13B:
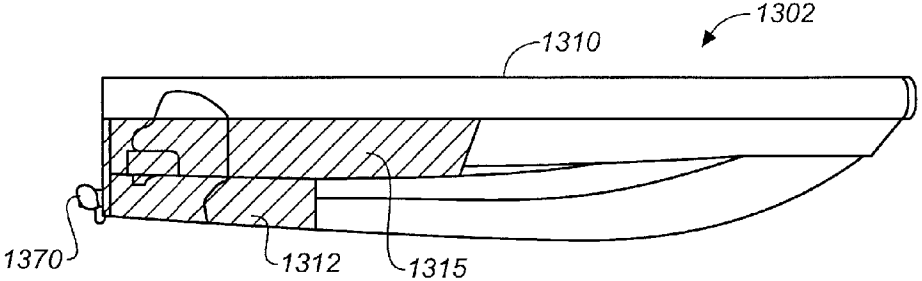
Figure 13D:
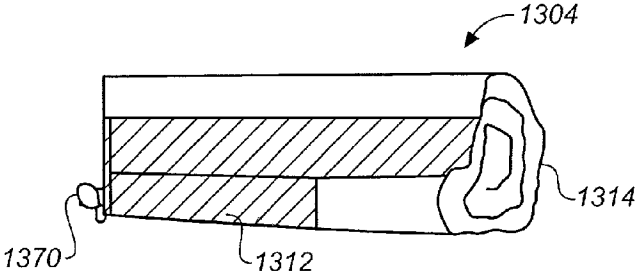

In further embodiments, inflatable bladders of other shapes and configuration, or rigid non-inflatable structures may be incorporated into the inflatable watercraft assembled by the methods and techniques disclosed herein. In some examples and applications, the requirement for additional support features within the inflatable watercraft may require the inclusion of such features. For example, FIGS. 13A-13D illustrate bottom and side elevations of another example of an inflatable watercraft with reinforced panels, according to yet further embodiments of the invention. Inflatable watercraft 1300 includes inflatable structure 1310, rigid structure 1312, and waterjet 1370. Inflatable structure 1310 is assembled from the web reinforced fabrics described with regard to FIGS. 2A-2B and using the techniques discussed herein. In view 1302 of FIG. 13B, inflatable structure 1310 includes a collar, main hull and amas 1315 disposed on both sides of the main hull. Inflatable structure 1310 is formed from the reinforced panels, with overlapping of panels, selective pressurization of panels or groups of panels and hydrodynamic feature control, described previously. Rigid structure 1312, shown in the hatched area, represents the amidship and aft components of the hull formed from a rigid material such as a composite or aluminum, and which provide integral cross-structure for outer hull support, which is useful in some applications. To this end, extended portions 1320, 1322 of rigid structure 1312 enable rigidity for the floor of the watercraft and also provides support for heavy payload transport relative to the amas 1315. View 1303 of FIG. 13C depicts a bottom view of the deflated portion 1311 of the inflatable structure 1310 in a stowed configuration. In FIG. 13D, view 1304 shows the deflated portion of the inflatable structure in a rolled configuration 1314.

In certain applications, rigid structure 1312 provides a mounting surface and support for use of a waterjet. In other examples, the non-inflatable material of rigid structure 1312 enables crew seating (not shown) to be incorporated on board the inflatable watercraft. In some embodiments, it will be a requirement that the remainder of watercraft 1300 be assembled with web reinforced fabrics. Examples of such embodiments includes the reduction in stowage volumes, and improved absorption of hull slamming effects coupled with preservation of the inflatable hull shape and integrity in varied sea states. It will be apparent that other shapes and configurations of the rigid structure are possible, but with trade off in the amount of non-inflatable material, weight of the watercraft and effects upon stowage footprint. Additionally, when the inflatable structure 1310 is attached to the rigid structure 1312, the critical ETM hull structure and water-tight integrity are maintained, ensuring appropriate waterflow to the inlet for waterjet 1370. In other embodiments, it will be a requirement that the remainder of watercraft 1300 be assembled with a combination of web reinforced fabrics with other configurations and orientation of non-inflatable rigid materials.

For those embodiments where waterjet inclusion is desired, as seen in FIGS. 1 (power head/waterjet propulsion module 160) and 13B, the optional integration of a waterjet to achieve power head propulsion facilitates improved deployment and recovery operations, and maneuverability for shallow water operations. By comparison to conventional rigid inflatable boats, the inflatable watercraft of FIGS. 13A-13D achieves a reduction in stowage volume and weight.

Figure 14A:
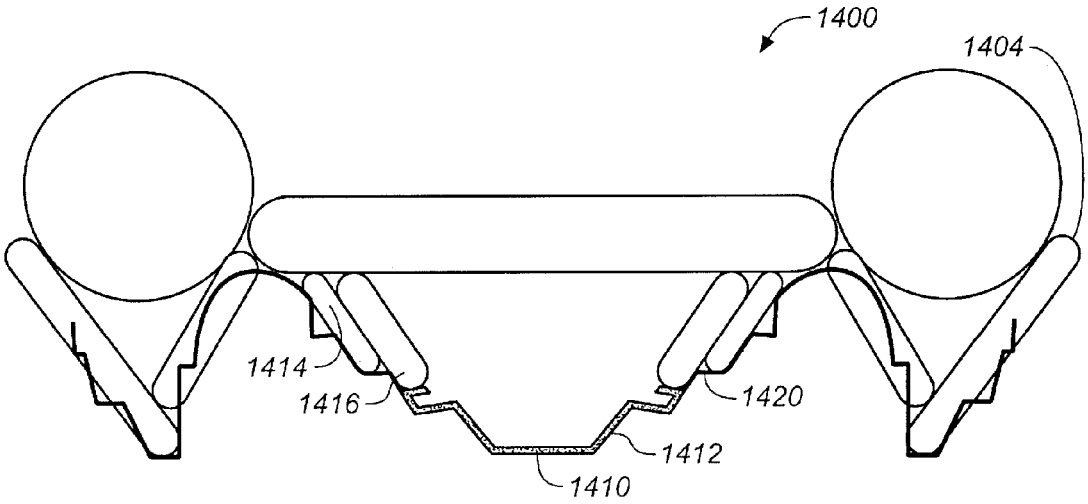
FIGS. 14A-14B illustrate transverse cross-sectional views of the aft portion of an inflatable watercraft, according to yet further embodiments of the invention.
Figure 14B:
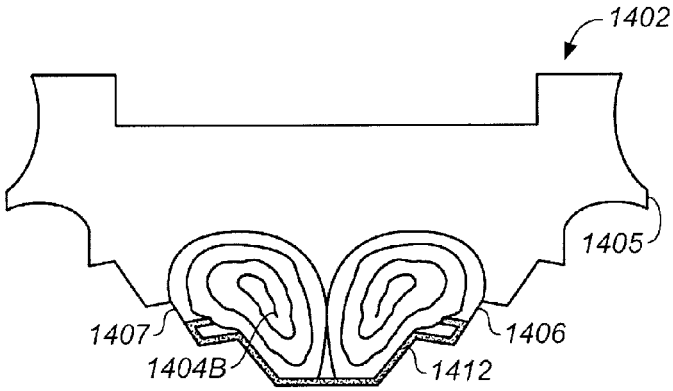

FIGS. 14A-14B illustrate transverse cross-sectional views of the aft portion of an inflatable watercraft, according to yet further embodiments of the invention. Watercraft 1400 includes outboard inflatable portions 1404, amas, a collar and a floor as described with other embodiments previously. Additionally, watercraft 1400 includes a rigid structure 1412 with transom 1405 and pad keel 1410. The reinforced panels 1416 and 1414 and strake 1420 are formed from the web reinforced fabrics described herein, in accordance with the methods for overlapping, selectively pressurizing one or more panels or groups of panels and hydrodynamic control, and are thus, inflatable. The combination of these components enable integrity of the hull structure and rigid planing surfaces for overload payload conditions. Examples of parameters for the inflatable watercraft of FIGS. 14A-14B include a 7 m hull length and rigid structure 1412 comprising a rigid material such as a composite or aluminum. As shown in view 1402 of FIG. 14B, when deflated, the outboard inflatable portions 1404B of the hull are rolled and stored 1406, 1407 in the central, non-inflatable rigid structure 1412.

Figure 15A:
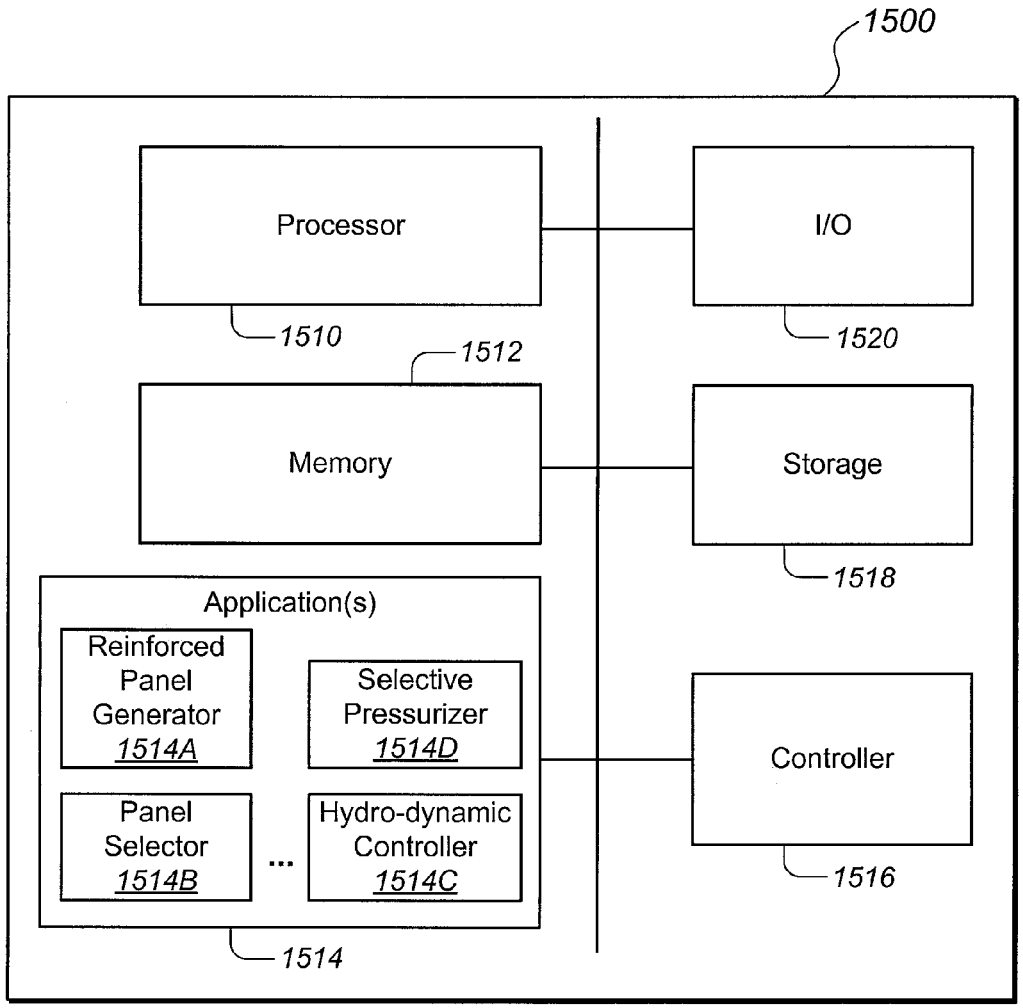
FIG. 15A illustrates a schematic diagram of a processor-based apparatus configured to operate a system for assembling an inflatable watercraft with reinforced panels, according to yet further embodiments of the invention.

FIG. 15A illustrates a schematic diagram of a processor-based apparatus configured to operate a system for assembling an inflatable watercraft with reinforced panels, according to yet further embodiments of the invention. As shown, a data processing system 1500 suitable for storing and/or executing program code can be provided hereunder and can include at least a microprocessor 1510, communicatively coupled, directly or indirectly, to memory 1512 which may be RAM and/or ROM, applications 1514, controller 1516, memory storage 1518 which may be a hard drive, and input/output (I/O) interface 1520 (for facilitating control input, keyboards, displays, pointing devices, etc.). In some embodiments, the functionality of the reinforced panel generator 120 (of FIG. 1) can be implemented as a software application 1514A, the panel selector 130 can be implemented in software via application 1514B, the hydrodynamic controller 140 can be implemented in software with hydrodynamic controller application 1514C, and the selective pressurizer 150 can be implemented in software via selective pressurizer application 1514D. Such software can be embodied as computer program instructions, which may be stored in a computer readable medium that can direct a computer, other programmable data processing apparatus, or other devices to function in a particular manner, such that the instructions stored in the computer readable medium produces an article of manufacture including instructions which implement the function/act specified in the flowchart and/or block diagram block or blocks described herein. A computer readable medium is a tangible medium that can contain, or store a program for use by or in connection with an instruction execution system, apparatus, or device. Furthermore and in other embodiments, the computer program instructions may be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks described herein. Examples of the computer readable storage medium include: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or combination of the foregoing.

Figure 15B:
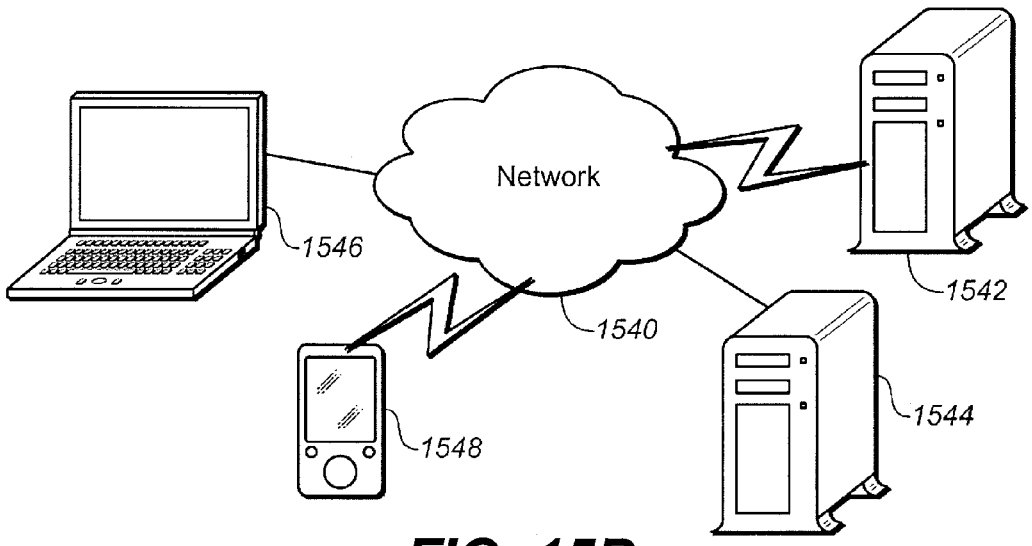
FIG. 15B illustrates a block diagram of an example of a computer system architecture, according to an embodiment.

FIG. 15B illustrates a block diagram of an example of a computer system architecture, according to an embodiment. Software applications 1514 may be deployed from one or more servers 1542 (wireless in communication with a network 1540), 1544 (hardwired to be communicatively coupled to network 1540) to one or more deployment sites, such as user devices 1546, 1548. In the example illustrated, the devices 1546, 1548, which can include web browsing capability, may comprise various embodiments, such as a personal computer, portable computer, personal digital assistant, wireless smart phone, tablet device (e.g., iPad™ device) or other device configured to access the servers 1542, 1544 via network 1540. Data connectivity enabling devices 1546, 1548 to communicate with network 1540 include: wireless data standards (e.g., IEEE 802.11, 1999 Edition, LAN/MAN Wireless LANS (WiFi), IEEE 802.16-2004, LAN/MAN Broadband Wireless LANS (WiMAX), etc.), cellular telephone protocols (e.g., W-CDMA (UMTS), CDMA2000 (IS-856/IS-2000), etc.), hard-wired data connection (e.g., RS-232 (Electronic Industries Alliance/EIA), Ethernet (e.g., IEEE 802.3-2005, LAN/MAN CSMA/CD Access Method), power line communication (e.g., X10, IEEE P1675), USB (e.g., Universal Serial Bus 2.0 Specification)), etc., depending upon the embodiment. Devices 1546, 1548 can be located in the same physical location or in different locations. In some embodiments, the applications 1514 may be implemented on a remote computer server, via the internet (in the "cloud"), and offered under Software-As-A-Service (SaaS), Platform-As-A-Service (PaaS) or other cross-platform models, and in some examples for a subscription fee.

A detailed description of one or more examples is provided herein along with accompanying figures. The detailed description is provided in connection with such examples, but is not limited to any particular example. The scope is limited only by the claims, and numerous alternatives, modifications, and equivalents are encompassed. Numerous specific details are set forth in the description in order to provide a thorough understanding. These details are provided as examples and the described techniques may be practiced according to the claims without some or all of the accompanying details. They are not intended to be exhaustive or to limit the invention to the precise forms disclosed, as many alternatives, modifications, equivalents, and variations are possible in view of the above teachings. For clarity, technical material that is known in the technical fields related to the examples has not been described in detail to avoid unnecessarily obscuring the description.

The various examples of the invention may be implemented in numerous ways, including as a system, a process, apparatus, and computer program product. In general, the flows of disclosed processes may be performed in an arbitrary order, unless otherwise provided in the claims. For example, the flowcharts and block diagrams in the figures illustrate the architecture, functionality and operation of possible implementations of systems, apparatus, methods and computer program products according to various embodiments of the invention. To this end, each block in a flowchart or block diagram may represent a module, segment, or portion of code, which includes one or more executable instructions for implementing the specified logic function(s). It should be understood that, in some alternative implementations, the functions noted in the blocks may occur out of the order noted in the figures. For example, two blocks shown in succession may, in fact, be executed substantially concurrently, or the blocks may sometimes be executed in the reverse order, depending upon the functionality involved. It will be appreciated that each block represented in a block diagram or flowchart illustration, as well as combinations of blocks appearing therein, can be implemented by special purpose hardware-based systems that perform the specified functions or acts, or combinations of special purpose hardware and computer instructions. In addition, the terms, "group 1", "group 2," etc. are used herein only to facilitate discussion, and carry no particular temporal or chronological significance unless otherwise indicated.

The description, for purposes of explanation, uses specific nomenclature to provide a thorough understanding of the invention. However, it will be apparent that specific details are not required in order to practice the invention. In fact, this description should not be read to limit any feature or aspect of the present invention to any embodiment; rather features and aspects of one example can readily be interchanged with other examples. Notably, not every benefit described herein need be realized by each example of the present invention; rather any specific example may provide one or more of the advantages discussed above. In the claims, elements and/or operations do not imply any particular order of operation, unless explicitly stated in the claims. It is intended that the following claims and their equivalents define the scope of the invention.

What is claimed is:

1. A watercraft, comprising: a center hull having a V-shape comprised of a first set of inflatable panels, said center hull supporting a floor that is coupled to a U-shaped collar; a pair of outer side hulls comprised of a second set of inflatable panels respectively disposed on opposite sides of the center hull and defining a tunnel between the center hull and each of the outer side hulls, the second set of inflatable panels extending from amidship to aft of the watercraft and supporting the floor and collar; a third set of inflatable panels disposed between the center hull and the floor; and a stepped deadrise to the center hull comprised of a fourth set of inflatable panels coupled to the first set of inflatable panels.

2. A watercraft, comprising: a center hull having a V-shape comprised of a first set of inflatable panels, said center hull supporting a floor that is coupled to a U-shaped collar; a pair of outer side hulls comprised of a second set of inflatable panels respectively disposed on opposite sides of the center hull and defining a tunnel between the center hull and each of the outer side hulls, the second set of inflatable panels extending from amidship to aft of the watercraft and supporting the floor and collar; and a strake extending longitudinally along the watercraft and disposed on an outboard side of each of the outer side hulls, said strake comprising a subset of the second set of inflatable panels that are overlapped and oriented together.

3. A watercraft, comprising: a center hull having a V-shape comprised of a first set of inflatable panels, said center hull supporting a floor that is coupled to a U-shaped collar; a pair of outer side hulls comprised of a second set of inflatable panels respectively disposed on opposite sides of the center hull and defining a tunnel between the center hull and each of the outer side hulls, the second set of inflatable panels extending from amidship to aft of the watercraft and supporting the floor and collar; and a strake extending longitudinally along the watercraft and disposed on an inboard side of each of the outer side hulls, said strake comprising a subset of the second set of inflatable panels that are overlapped and oriented together.

4. An inflatable watercraft, comprising:

a center hull having transverse V-shaped deadrise and comprised of a first set of inflatable reinforced panels arranged to define a stepped configuration, said first set of inflatable reinforced panels supporting a floor that is coupled to a U-shaped collar;

a transom coupled to the floor and the U-shaped collar at an aft end of the inflatable watercraft; and, a pair of outer side hulls comprised of a second set of inflatable reinforced panels, each of the outer side hulls respectively disposed on opposite sides of the center hull, the pair of outer side hulls defining a tunnel between the center hull and each of the outer side hulls, wherein the second set of inflatable reinforced panels extends longitudinally along the inflatable watercraft from amidship to aft of the inflatable watercraft and supports the floor and the U-shaped collar, wherein said floor comprises a third set of inflatable reinforced panels.

5. The inflatable watercraft of claim 4, wherein each of the first, second and third sets of inflatable reinforced panels comprises a web reinforced fabric selected from one of a group of drop stitch fabric, and one or more air cells encased in a fabric surround.

* * * * *

UNITED STATES PATENT AND TRADEMARK OFFICE

CERTIFICATE OF CORRECTION

PATENT NO. : 8,800,466 B1
APPLICATION NO. : 13/166795
DATED : August 12, 2014
INVENTOR(S) : Gary Shimozono et al.

It is certified that error appears in the above-identified patent and that said Letters Patent is hereby corrected as shown below:

In the Specification

At column 8, line 26, replace “573” with --571--.

Signed and Sealed this
Fourteenth Day of October, 2014

Michelle K. Lee

Michelle K. Lee
*Deputy Director of the United States Patent and Trademark Office*